US009790659B2

(12) United States Patent
Sugano et al.

(10) Patent No.: US 9,790,659 B2
(45) Date of Patent: Oct. 17, 2017

(54) HYDRAULIC SHOVEL

(71) Applicants: Kobe Steel, Ltd., Kobe-shi (JP); KOBELCO CONSTRUCTION MACHINERY CO., LTD., Hiroshima-shi (JP)

(72) Inventors: Naoki Sugano, Kobe (JP); Takao Nanjo, Kobe (JP); Shota Oguma, Kobe (JP); Satoshi Maekawa, Hiroshima (JP); Koji Ueda, Hiroshima (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 105 days.

(21) Appl. No.: 14/775,256

(22) PCT Filed: Feb. 27, 2014

(86) PCT No.: PCT/JP2014/001079
§ 371 (c)(1),
(2) Date: Sep. 11, 2015

(87) PCT Pub. No.: WO2014/155972
PCT Pub. Date: Oct. 2, 2014

(65) Prior Publication Data

US 2016/0024749 A1 Jan. 28, 2016

(30) Foreign Application Priority Data

Mar. 28, 2013 (JP) ..... 2013-069308

(51) Int. Cl.
*F15B 11/17* (2006.01)
*E02F 9/22* (2006.01)
(Continued)

(52) U.S. Cl.
CPC ..... *E02F 3/425* (2013.01); *E02F 3/32* (2013.01); *E02F 9/2239* (2013.01);
(Continued)

(58) Field of Classification Search
CPC . E02F 3/425; E02F 3/32; E02F 9/2239; E02F 9/2242; E02F 9/2282; E02F 9/2285;
(Continued)

(56) References Cited

U.S. PATENT DOCUMENTS 3,581,919 A * 6/1971 Karlsson ..... E02F 3/32 414/694
6,087,945 A * 7/2000 Yasuda ..... E02F 9/2235 116/168
(Continued)

FOREIGN PATENT DOCUMENTS

CN 102203434 A 9/2011
CN 102518171 A 6/2012
(Continued)

OTHER PUBLICATIONS

International Search Report dated Apr. 28, 2014, in PCT/JP2014/001079 filed Feb. 27, 2014.
(Continued)

*Primary Examiner* — F. Daniel Lopez
*Assistant Examiner* — Dustin T Nguyen
(74) *Attorney, Agent, or Firm* — Oblon, McClelland, Maier & Neustadt, L.L.P.

(57) ABSTRACT

Provided is a hydraulic shovel capable of moving a boom, an arm, and a bucket at respective adequate speeds even during complex operations thereof, without a significant pressure loss. This hydraulic shovel includes: a first pump (31) connected to a boom actuator (24) and a bucket actuator (28); a second pump (32) connected to an arm actuator (26) and the boom actuator (24); a third pump (33) connect to the
(Continued)

arm actuator (26); a boom control valve (54) interposed between the first pump (31) and the boom actuator (24); an arm control valve (56) interposed between the second pump (32) and the arm actuator (26); a bucket control valve (58) interposed between the first pump (31) and the bucket actuator (28); a boom merging valve (55) for speed increase interposed between the second pump (32) and the boom actuator (24); and an arm merging valve (57) for speed increase interposed between the third pump (33) and the arm actuator (26).

6 Claims, 9 Drawing Sheets

(51) Int. Cl.
*E02F 3/42* (2006.01)
*E02F 3/32* (2006.01)
*F15B 13/06* (2006.01)

(52) U.S. Cl.
CPC ..... *E02F 9/2242* (2013.01); *E02F 9/2282* (2013.01); *E02F 9/2285* (2013.01); *E02F 9/2292* (2013.01); *E02F 9/2296* (2013.01); *F15B 11/17* (2013.01); *F15B 13/06* (2013.01); *F15B 2211/20546* (2013.01); *F15B 2211/20576* (2013.01); *F15B 2211/30565* (2013.01); *F15B 2211/30595* (2013.01); *F15B 2211/45* (2013.01); *F15B 2211/50536* (2013.01); *F15B 2211/7135* (2013.01); *F15B 2211/7142* (2013.01)

(58) Field of Classification Search
CPC ..... E02F 9/2292; E02F 9/2296; F15B 11/17; F15B 2211/50536; F15B 2211/7135; F15B 2211/7142; F15B 2211/30565; F15B 2211/20576; F15B 2211/20546; F15B 2211/30595; F15B 13/06; F15B 2211/45
USPC ..... 60/421, 486
See application file for complete search history.

(56) References Cited

U.S. PATENT DOCUMENTS

| | | | | |
|---|---|---|---|---|
| 6,244,048 | B1 * | 6/2001 | Tanaka | E02F 9/2242 60/421 |
| 6,314,726 | B1 * | 11/2001 | Meyer | E02F 9/2025 60/394 |
| 2005/0226732 | A1 * | 10/2005 | Bae | E02F 9/2228 417/53 |
| 2006/0156714 | A1 * | 7/2006 | Kim | E02F 9/2285 60/422 |
| 2010/0162696 | A1 | 7/2010 | Kakizawa et al. | |
| 2011/0197576 | A1 | 8/2011 | Wada et al. | |
| 2011/0308242 | A1 * | 12/2011 | Pfaff | E02F 9/2242 60/327 |
| 2012/0163949 | A1 * | 6/2012 | Okano | E02F 9/2239 414/685 |
| 2014/0090369 | A1 * | 4/2014 | Nakamura | E02F 9/2242 60/459 |
| 2015/0044007 | A1 * | 2/2015 | Tajima | E02F 9/2235 414/685 |

FOREIGN PATENT DOCUMENTS

| | | | |
|---|---|---|---|
| DE | 199 11 440 | A1 | 9/2000 |
| EP | 0 874 090 | A1 | 10/1998 |
| JP | 57-205638 | A | 12/1982 |
| JP | 60-058661 | U | 4/1985 |
| JP | 2000-336700 | A | 12/2000 |
| JP | 2003-184815 | A | 7/2003 |
| JP | 2008-274988 | A | 11/2008 |
| JP | 2009-002441 | A | 1/2009 |
| JP | 2010-261196 | A | 11/2010 |
| KR | 10-2007-0103573 | A | 10/2007 |
| WO | WO 2009/029925 | A2 | 3/2009 |
| WO | WO 2012/157705 | A1 | 11/2012 |

OTHER PUBLICATIONS

Extended European Search Report dated May 10, 2016 in Patent Application No. 14776370.0.

* cited by examiner

HYDRAULIC SHOVEL

TECHNICAL FIELD

The present invention relates to a hydraulic shovel including a boom, an arm, a bucket, and respective hydraulic actuators for actuation thereof.

BACKGROUND ART

There is known a hydraulic shovel as described above, the hydraulic shovel including a plurality of hydraulic pumps for driving respective hydraulic actuators. For example, Patent Literature 1 discloses a hydraulic shovel equipped with a hydraulic circuit as shown in FIG. 9.

Specifically, the circuit shown in FIG. 9 includes: a first pump 101, a second pump 102, and a third pump 103, each pump being a hydraulic pump driven by an engine 100; a boom cylinder 111, an arm cylinder 112, and a bucket cylinder 113 which are respective hydraulic actuators for the boom, arm, and bucket; a slewing motor 114 for slewing an upper slewing body on which the boom is installed; a boom remote control valve 121, an arm remote control valve 122, and a bucket remote control valve 123 for operating the boom, arm, and bucket, respectively; a first boom control valve B1 and a second boom control valve B2 for controlling the operation of the boom cylinder 111 according to the operation applied to the boom remote control valve 121; a first arm control valve A1 and a second arm control valve A2 for controlling the operation of the arm cylinder 112 according to the operation applied to the arm remote control valve 122; a bucket control valve BU for controlling the operation of the bucket cylinder 113 according to the operation applied to the bucket remote control valve 123; and a slewing control valve SL for controlling the operation of the slewing motor 114.

To respective discharge ports of the first to third pumps 101 to 103, connected are first, second, and third center bypass lines 141, 142, 143 running from the respective discharge ports of the first to third pumps 101 to 103 to a tank. To the first center bypass line 141 are connected the first arm control valve A1 and the second boom control valve B2 in the order of description from the upstream side along the line, so as to be arranged in a tandem; to the second center bypass line 142, connected are the bucket control valve BU, the first boom control valve B1 and the second arm control valve A2 in the order of description from the upstream side along the line, so as to be arranged in a tandem; and to the third center bypass line 143 is connected the slewing control valve SL.

Each control valve is formed of a three-position hydraulic pilot controlled selector valve having a neutral position and respective operation positions at both sides of the neutral position, configured to be shifted from the neutral portion to either of the operation positions by the operation applied to the remote control valve corresponding to this control valve. In the neutral position, each control valve forms an oil path for opening the center bypass line to which the control valve is connected; in either of the operation positions, each control valve forms an oil path for leading a part of the hydraulic oil flowing in the center bypass line to a hydraulic actuator corresponding to the control valve (for example, the boom cylinder 111).

However, the circuit shown in FIG. 9, in which the plurality of control valves are arranged in tandems along the respective first and second center bypass lines 141, 142, fails to permit the hydraulic oil to be supplied at a sufficient flow rate to the hydraulic actuator corresponding to the downstream control valve when the upstream control valve is operated with a large stroke. This causes inconvenience that the motion of the hydraulic is slowed. For example, in the second center bypass line 142, when there is applied a full operation or an operation close thereto to the first boom control valve B1 connected to the second center bypass line 142, the second arm control valve A2 positioned downstream thereof cannot be supplied with the hydraulic oil at a sufficient flow rate. This causes inconvenience is that the motion of the arm cylinder 112 connected to the second arm control valve A2 is slowed.

As means for avoiding such inconveniences, there can be conceived, for example, providing a parallel line branched off from the second center bypass line 142 upstream of the first boom control valve B1 to reach the second arm control valve A2 while so as to bypass the first boom control valve. However, this may causes the flow rate of the hydraulic oil to be biased to the second arm control valve A2 and the arm cylinder 112 upon such an operation that the drive load on the arm cylinder 112 becomes much smaller than the drive load on the boom cylinder 111 (for example, the operation of retracting the bucket above or on the ground by a combination of a boom raising operation and an arm retracting operation), which conversely hinders the boom cylinder 111 from normal operation. Avoiding this trouble requires a throttle performing a large flow-rate-restriction in the parallel line, the addition thereof involves a great increase in the pressure loss on the meter-in side.

Although the circuit shown in FIG. 9 includes the third pump 103 in addition to the first pump 101 and the second pump 102, the third pump 103 is used exclusively for slewing drive, not contributing to adequate actuations of the boom, arm, and bucket.

CITATION LIST

Patent Literature

Patent Literature 1: Japanese Unexamined Patent Publication No. 2008-274988.

SUMMARY OF INVENTION

It is an object of the present invention to provide a hydraulic shovel capable of allowing a boom, an arm, and a bucket which to be moved at respective adequate speeds even upon a complex operation therefor while involving no significant pressure loss. As means for attaining such an object, the present invention provides the following first and second hydraulic shovels having common technical features.

The first hydraulic shovel includes: a base; a boom mounted on the base so as to be raised and lowered; an arm rotatably coupled to a distal end of the boom; a bucket rotatably coupled to a distal end of the arm; a boom hydraulic actuator that is operated so as to raise and lower the boom by receiving supply of hydraulic oil; an arm hydraulic actuator that is operated so as to rotate the arm relatively to the boom by receiving supply of hydraulic oil; a bucket hydraulic actuator that is operated so as to rotate the bucket relatively to the arm by receiving supply of hydraulic oil; a first pump that is formed of a hydraulic pump discharging a hydraulic oil, the first pump connected in parallel to the boom hydraulic actuator and the bucket hydraulic actuator; a second pump that is formed of a hydraulic pump discharging a hydraulic oil, the second pump connected in parallel to the arm hydraulic actuator and the boom hydraulic actuator; a third pump that is formed of a hydraulic pump discharging a hydraulic oil, the third pump connected to the arm hydraulic actuator; a boom operation member to which an operation for moving the boom hydraulic actuator is applied; an arm operation member to which an operation for moving the arm hydraulic actuator is applied; a bucket operation member to which an operation for moving the bucket hydraulic actuator is applied; a boom control valve interposed between the first pump and the boom hydraulic actuator and configured to be opened in response to the operation applied to the boom operation member to control the supply of the hydraulic oil from the first pump to the boom hydraulic actuator; an arm control valve interposed between the second pump and the arm hydraulic actuator and configured to be opened in response to the operation applied to the arm operation member to control the supply of the hydraulic oil from the second pump to the arm hydraulic actuator; a bucket control valve interposed between the first pump and the bucket hydraulic actuator and configured to be opened in response to the operation applied to the bucket operation member to control the supply of the hydraulic oil from the first pump to the bucket hydraulic actuator; a boom merging valve interposed between the second pump and the boom hydraulic actuator and configured to be opened only when an amount of the operation applied to the boom operation member exceeds a preset boom-speed-increase-start operation amount to permit the hydraulic oil discharged by the second pump to be merged into the hydraulic oil supplied from the first pump to the boom hydraulic actuator; and an arm merging valve interposed between the third pump and the arm hydraulic actuator and configured to be opened only when an amount of the operation applied to the arm operation member exceeds a preset arm-speed-increase-start operation amount to permit the hydraulic oil discharged by the third pump to be merged into the hydraulic oil supplied from the second pump to the arm hydraulic actuator.

The second hydraulic shovel includes: a base; a boom mounted on the base so as to be raised and lowered; an arm rotatably coupled to a distal end of the boom; a bucket rotatably coupled to a distal end of the arm; a boom hydraulic actuator that is operated so as to raise and lower the boom by receiving supply of hydraulic oil; an arm hydraulic actuator that is operated so as to rotate the arm relatively to the boom by receiving supply of hydraulic oil; a bucket hydraulic actuator that is operated so as to rotate the bucket relative to the arm by receiving supply of hydraulic oil; a first pump that is formed of a hydraulic pump discharging a hydraulic oil, the first pump connected in parallel to the arm hydraulic actuator and the bucket hydraulic actuator; a second pump that is formed of a hydraulic pump discharging a hydraulic oil, the second pump connected in parallel to the arm hydraulic actuator and the boom hydraulic actuator; a third pump that is formed of a hydraulic pump discharging a hydraulic oil, the third pump connected to the boom hydraulic actuator; a boom operation member to which an operation for moving the boom hydraulic actuator is applied; an arm operation member to which an operation for moving the arm hydraulic actuator is applied; a bucket operation member to which an operation for moving the bucket hydraulic actuator is applied; a boom control valve interposed between the third pump and the boom hydraulic actuator and configured to be opened in response to the operation of the boom operation member to control the supply of the hydraulic oil from the third pump to the boom hydraulic actuator; an arm control valve interposed between the second pump and the arm hydraulic actuator and configured to be opened in response to the operation applied to the arm operation member to control the supply of the hydraulic oil from the second pump to the arm hydraulic actuator; a bucket control valve interposed between the first pump and the bucket hydraulic actuator and configured to be opened in response to the operation applied to the bucket operation member to control the supply of the hydraulic oil from the first pump to the bucket hydraulic actuator; a boom merging valve interposed between the second pump and the boom hydraulic actuator and configured to be opened only when an amount of the operation applied to the boom operation member exceeds a preset boom-speed-increase-start operation amount to permit the hydraulic oil discharged by the second pump to be merged into the hydraulic oil supplied from the third pump to the boom hydraulic actuator; and an arm merging valve interposed between the first pump and the arm hydraulic actuator and configured to be opened only when an amount of the operation applied to the arm operation member exceeds a preset arm-speed-increase-start operation amount to permit the hydraulic oil discharged by the first pump to be merged into the hydraulic oil supplied from the second pump to the arm hydraulic actuator.

In summary, the first and second hydraulic shovels in accordance with the present invention shares the following common features: (i) the first pump is connected, as a bucket drive pump, to the bucket hydraulic actuator through the bucket control valve; (ii) the second pump is connected, as a boom speed increase pump, to the boom hydraulic actuator through the boom merging valve and also connected, as an arm primary drive pump, to the arm hydraulic actuator through the arm control valve, and additionally share the following common feature; and further (iii) either one of the first pump and the third pump is connected, as a boom primary drive pump, to the boom hydraulic actuator through the boom control valve, and the other of the first pump and the third pump is connected, as an arm speed increase pump, to the arm hydraulic actuator through the arm merging valve.

DESCRIPTION OF EMBODIMENTS

There will be described preferable embodiments of the present invention with reference to FIGS. 1 to 8.

Figure 1:
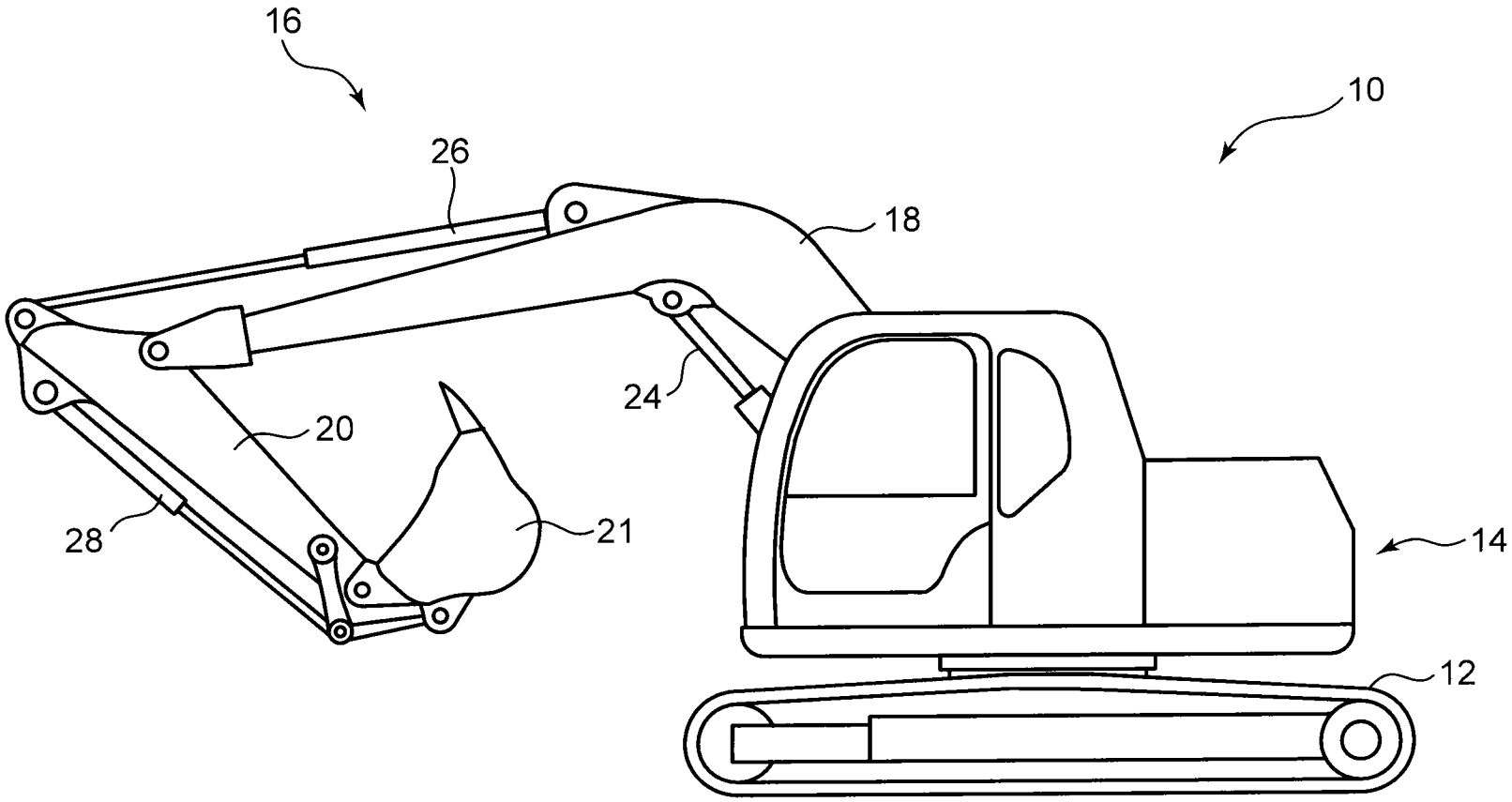
FIG. 1 shows the entire configuration of the hydraulic shovel according to the embodiments of the present invention.

FIG. 1 shows the external appearance of a hydraulic shovel 10 according to the embodiments of the present invention. The hydraulic shovel includes a lower traveling body 12, an upper slewing body 14 that is installed on the lower traveling body so as to be able to be slewed about a vertical axis, and a working attachment 16 mounted on the upper slewing body 14. The lower traveling body 12 and the upper slewing body 14 constitute a base. The working attachment 16 includes a boom 18 mounted on the upper slewing body 14 so as to be raised and lowered, an arm 20 rotatably coupled to the distal end of the boom 18, and a bucket 21 rotatably coupled to the distal end of the arm 20.

On the boom working attachment, mounted are a boom cylinder 24 which is a boom hydraulic actuator, an arm cylinder 26 which is an arm hydraulic actuator, and a bucket cylinder 28 which is a bucket hydraulic actuator. Each of the cylinders is formed of a telescopic hydraulic cylinder. The boom cylinder 24 is interposed between the boom 18 and the upper slewing body 14 so as to extend or contract upon receiving the supply of hydraulic oil to rotate the boom 18 in the raising and lowering direction. The arm cylinder 26 is interposed between the arm 20 and the boom 18 so as to extend or contract upon receiving the supply of hydraulic oil to thereby rotate the arm 20 around a horizontal axis relatively to the boom 18. The bucket cylinder 28 is interposed between the bucket 21 and the arm 20 so as to extend or contract upon receiving the supply of hydraulic oil to thereby rotate the bucket 21 around a horizontal axis relative to the arm 20.

Figure 2:
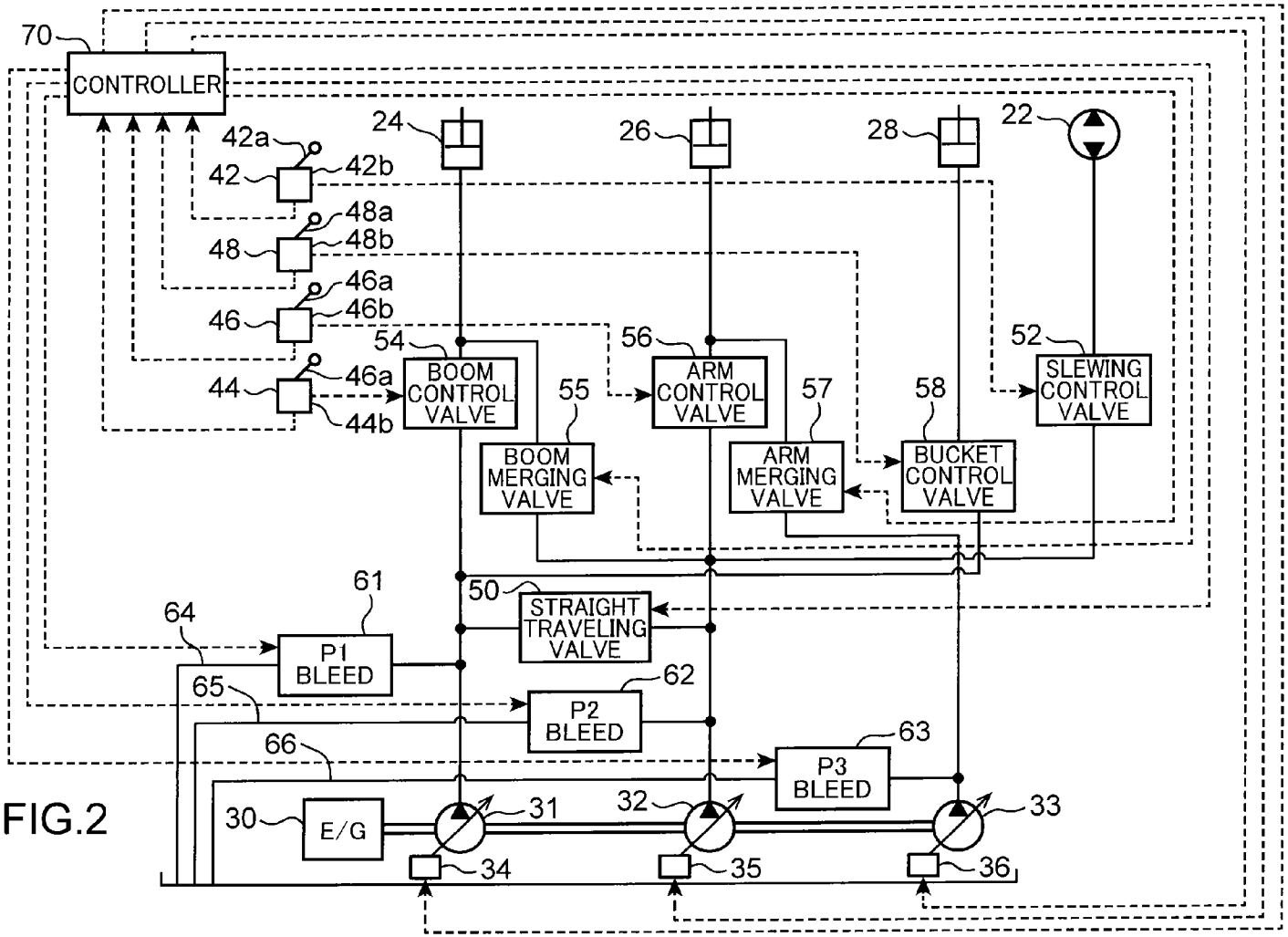
FIG. 2 shows a hydraulic circuit installed on the hydraulic shovel according to the first embodiment of the present invention.

FIG. 2 shows a hydraulic circuit installed at the hydraulic shovel according to the first embodiment of the present invention. The hydraulic circuit is provided for driving a plurality of hydraulic actuators including the cylinders 24, 26, 28 and a slewing motor 22 which is a hydraulic motor for slewing the upper slewing body 14, including a plurality of hydraulic pumps, a plurality of operation devices, and a plurality of control valves.

The plurality of hydraulic pumps include a first pump 31, a second pump 32, and a third pump 33. Each of the pumps is formed of a displacement-variable hydraulic pumps and connected to a common engine 30 to be driven by the engine 30. Specifically, regulators 34 to 36 are annexed to the first to third pumps 31 to 33, respectively, each configured to receive the input of the below-described displacement-volume command signals to adjust the displacement volume of each of the pumps 31 to 33 to the displacement volume corresponding to the displacement-volume command signals.

So as to assign drive of the slewing motor 22, primary drive (boom first speed) and speed increase (second boom speed) of the boom cylinder 24, primary drive (first speed of the arm) and speed increase (second arm speed) of the arm cylinder 26, and primary drive (first speed of the bucket) and speed increase (second speed of the bucket) of the bucket cylinder 28, the first to third pumps 31 to 33 according to the present embodiment are connected to the respective hydraulic actuators. Specifically, the first pump 31 is connected in parallel to the boom cylinder 24 and the bucket cylinder 28; the second pump 32 is connected in parallel to the arm cylinder 26, the boom cylinder 24, and the slewing motor 22; and the third pump 33 is connected to the arm cylinder 26. Although not graphically shown, the first pump 31 is connected to a left traveling motor through a left traveling control valve, and the second pump 32 is connected to a right traveling motor through a right traveling control valve.

The plurality of operation devices include a slewing operation device 42, a boom operation device 44, an arm operation device 46, and a bucket operation device 48. The operation devices 42, 44, 46, 48 have respective operation levers 42*a*, 44*a*, 46*a*, 48*a* each configured to receive a rotational operation, and respective remote control valves 42*b*, 44*b*, 46*b*, 48*b* each configured to output a pilot pressure having a magnitude corresponding to an amount of the operation applied to the operation lever from a port corresponding to the direction of the operation. The operation lever 42*a* of the slewing operation device 42 (namely, a slewing lever) corresponds to a slewing operation member to which an operation for moving the slewing motor 22 is applied. Similarly thereto, the operation lever 44*a* of the boom operation device 44 (namely, a boom lever) corresponds to a boom operation member to which an operation for moving the boom cylinder 24 is applied; the operation lever 46*a* of the arm operation device 46 (namely, an arm lever) corresponds to an arm operation member to which an operation for moving the arm cylinder 26 is applied; and the operation lever 48*a* of the bucket operation device 48 (namely, a bucket lever) corresponds to a bucket operation member to which an operation for moving the bucket cylinder 28 is applied.

The plurality of control valves include a straight traveling valve 50, a slewing control valve 52, a boom control valve 54, a boom merging valve 55, an arm control valve 56, an arm merging valve 57, a bucket control valve 58, a first bleed-off valve 61, a second bleed-off valve 62, and a third bleed-off valve 63.

The slewing control valve 52 is interposed between the second pump 32 and the slewing motor 22 and configured to be opened upon receiving the input of the pilot pressure output by the slewing operation device 42 to thereby control the supply of the hydraulic oil from the second pump 32 to the slewing motor 22. The slewing control valve 52 can be formed of, for example, a three-position pilot-controlled hydraulic selector valve, similarly to the below-described boom control valve 54 and arm control valve 56.

The boom control valve 54 is interposed between the first pump 31 and the boom cylinder 24 and configured to be opened upon receiving the input of the pilot pressure output by the boom operation device 44 to thereby control the supply of the hydraulic oil from the first pump 31 to the boom cylinder 24.

Figure 3:
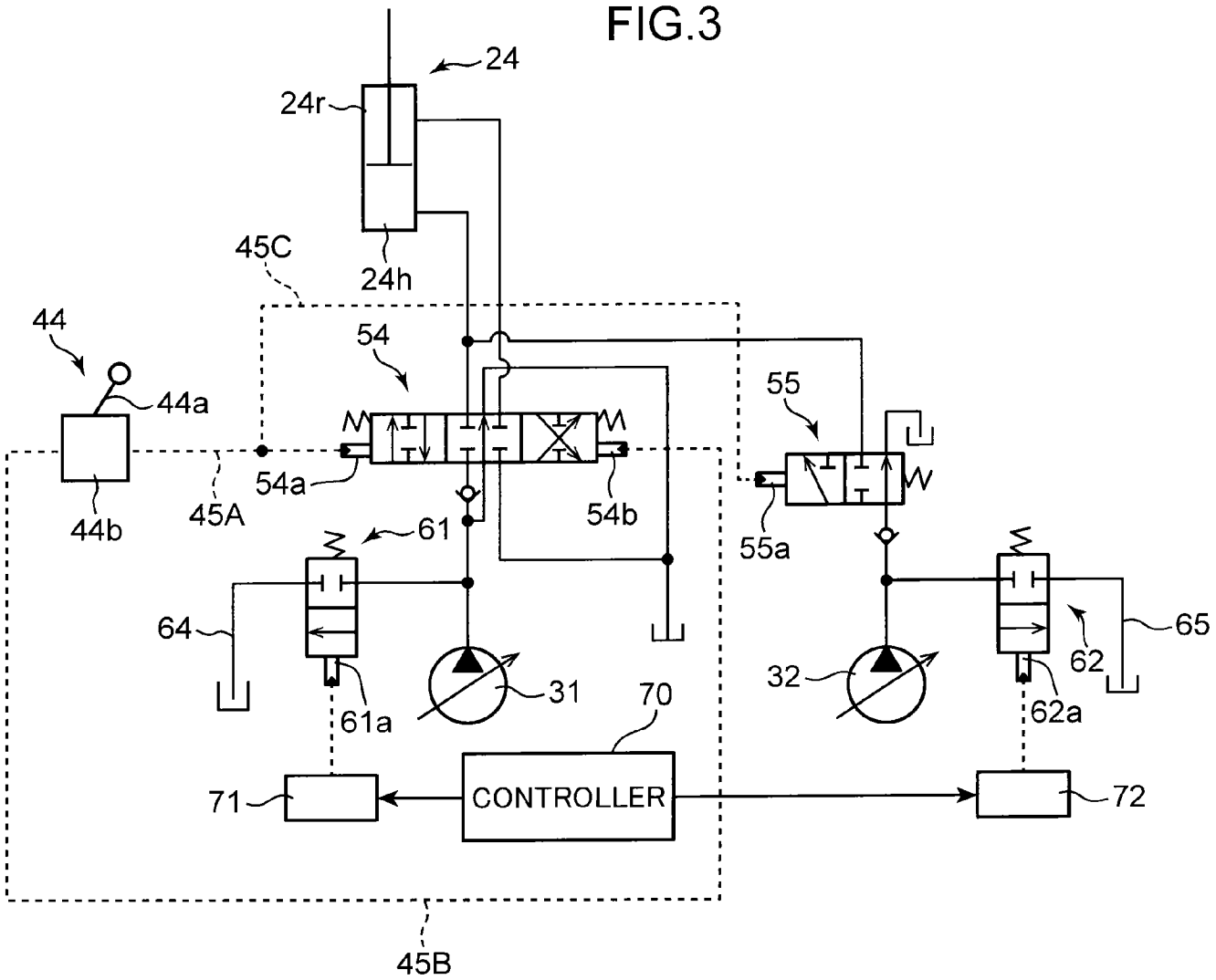
FIG. 3 is a hydraulic circuit diagram showing a boom cylinder included in the hydraulic circuit and hydraulic device connected thereto.

Specifically, the boom control valve 54 according to the present embodiment is formed of a three-position pilot-controlled selector valve having a pair of pilot ports 54*a*, 54*b* as shown in FIG. 3. The boom control valve 54 has a neutral position shown in the center of the figure, an extension operation position and a contraction operation position which are shown on respective left and right sides of the neutral position. When a pilot pressure equal to or higher than a predetermined pressure, specifically, a pilot pressure s equal to or higher than a boom start pilot pressure corresponding to a boom start operation amount which has been set in advance with respect to the operation of the boom lever 44*a*, is not input to either of the two pilot ports 54*a*, 54*b*, the boom control valve 54 is kept in the neutral position, thereby blocking the first pump 31 and the boom cylinder 24 from each other and forming an oil path for letting the hydraulic oil, which is discharged by the first pump 31, into a tank. When a pilot pressure exceeding the boom start pilot pressure is input to the pilot port 54*a*, the boom control valve 54 is shifted to the extension operation position and forms an oil path for leading the hydraulic oil, which is discharged by the first pump 31, to a head-side chamber 24*h* of the boom cylinder 24. When a pilot pressure exceeding the boom start pilot pressure is input to the pilot port 54*b*, the boom control valve 54 is shifted to the contraction operation position and forms an oil path for leading the hydraulic oil, which is discharged by the first pump 31, to a rod-side chamber 24*r* of the boom cylinder 24.

The boom merging valve 55 is interposed between the second pump 32 and the boom cylinder 24 and configured to be opened only when a pilot pressure for extending the boom cylinder 24 (that is, pilot pressure for boom raising operation), among the pilot pressures output by the boom operation device 44, exceeds a predetermined pressure, thereby permitting the hydraulic oil discharged by the second pump 32 to be merged into the hydraulic oil supplied from the first pump 31 into the head-side chamber 24*h* of the boom cylinder 24.

Specifically, the boom merging valve 55 according to the present embodiment is formed of a two-position pilot-controlled selector valve having a pilot port 55*a* as shown in FIG. 3. The boom merging valve 55 has a merging prevention position and a merging permission position which are shown on the right side and left side, respectively, in the figure. When a pilot pressure input to the pilot port 55*a* is equal to or less than a predetermined pressure (specifically, a boom-speed-increase-start pilot pressure corresponding to a boom-speed-increase-start operation amount which is set in advance as an amount of the operation applied to the boom lever 44*a* and is larger than the boom start operation amount), the boom merging valve 55 is kept in the merging prevention position, thereby blocking the second pump 32 and the boom cylinder 24 from each other and forming an oil path for letting the hydraulic oil, which is discharged by the second pump 32, into the tank. When a pilot pressure exceeding the boom-speed-increase-start pilot pressure is input to the pilot port 55*a*, the boom merging valve 55 is shifted to the merging permission position to form an oil path that permits the hydraulic oil, which is discharged by the second pump 32, to be merged into the hydraulic oil supplied from the first pump 31 into the head-side chamber 24*h* of the boom cylinder 24.

The remote control valve 44*b* for the boom has a boom raising output port and a boom lowering output port. The remote control valve 44*b* for the boom is configured to output a pilot pressure having a magnitude corresponding to the operation amount from the boom lowering output port when the boom lever 44*a* is operated in the boom raising direction, and is also configured to output a pilot pressure having a magnitude corresponding to the operation amount from the boom raising output port when the boom lever 44*a* is operated in the boom lowering direction. The boom raising output port is connected to the pilot port 54*a* of the boom control valve 54 through a pilot line 45A for boom raising control and also connected to the pilot port 55*a* of the boom merging valve 55 through a pilot line 45C for boom raising merging, the pilot line 45C branched off from the pilot line 45A for boom raising control. Meanwhile, the boom lowering output port is connected to the pilot port 54*b* of the boom control valve 54 through a pilot line 45B for boom lowering control.

The arm control valve 56 is interposed between the second pump 32 and the arm cylinder 26 and configured to be opened upon receiving the input of a pilot pressure output by the arm operation device 46 to thereby control the supply of hydraulic oil from the second pump 32 to the boom cylinder 26.

Figure 4:
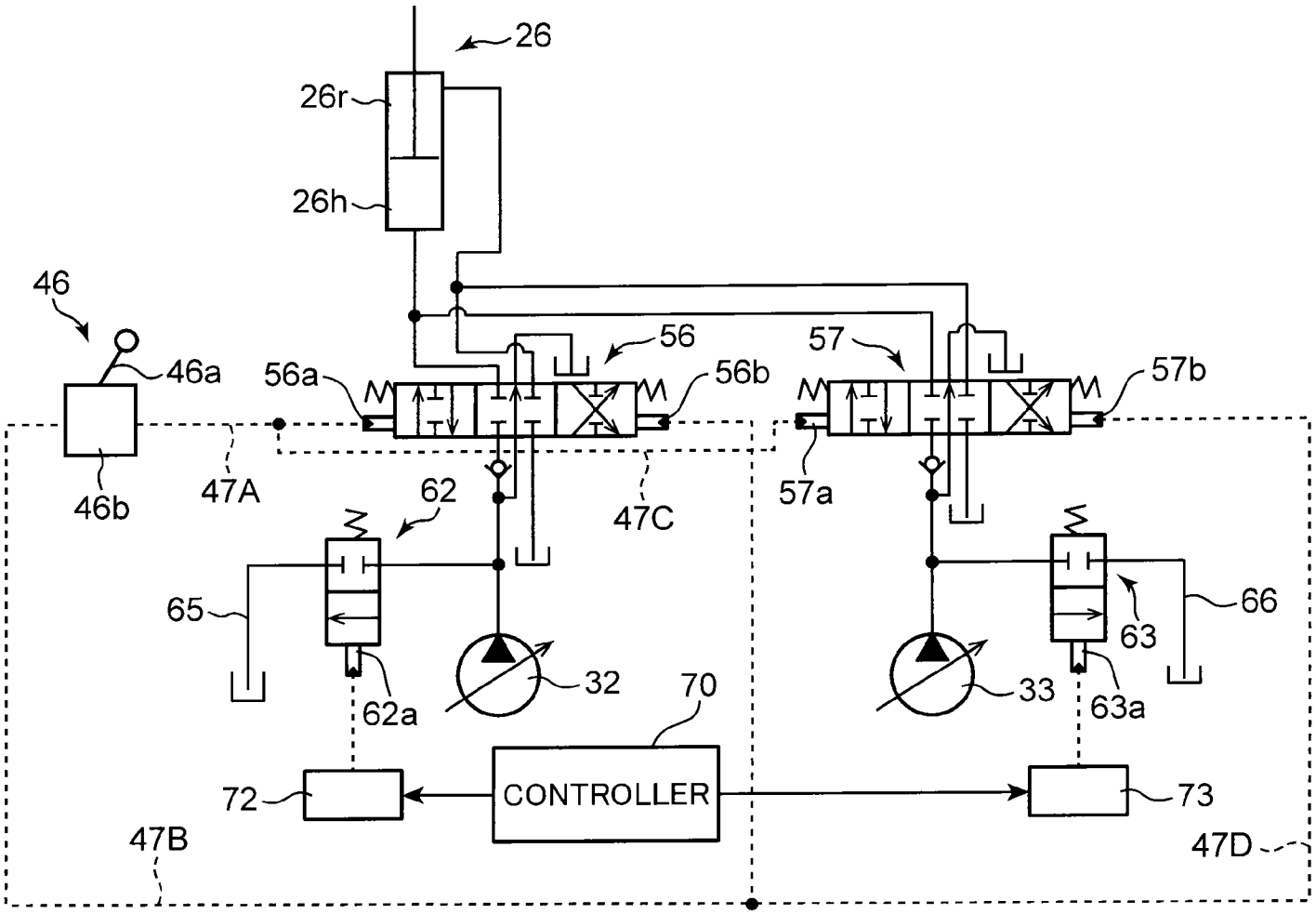
FIG. 4 is a hydraulic circuit diagram showing an arm cylinder included in the hydraulic circuit and hydraulic device connected thereto.

Specifically, the arm control valve 56 according to the present embodiment is formed of a three-position pilot-controlled selector valve having a pair of pilot ports 56*a*, 56*b* as shown in FIG. 4. The arm control valve 56 has a neutral position shown in the center of the figure, an extension operation position and a contraction operation position which are shown on respective left and right sides of the neutral position. When a pilot pressure equal to or higher than a predetermined pressure, specifically, a pilot pressure that is equal to or higher than an arm start pilot pressure corresponding to an arm start operation amount which has been set in advance with respect to the operation of the arm lever 46*a*, is not input to either of the two pilot ports 56*a*, 56*b*, the arm control valve 56 is kept in the neutral position, thereby blocking the second pump 32 and the arm cylinder 26 from each other and forming an oil path for letting the hydraulic oil, which is discharged by the second pump 32, into a tank. When a pilot pressure exceeding the arm start pilot pressure is input to the pilot port 56*a*, the arm control valve 56 is shifted to the extension operation position to form an oil path for leading the hydraulic oil, which is discharged by the second pump 32, to a head-side chamber 26*h* of the arm cylinder 26. When a pilot pressure exceeding the arm start pilot pressure is input to the pilot port 56*b*, the arm control valve 56 is shifted to the contraction operation position to form an oil path for leading the hydraulic oil, which is discharged by the second pump 32, to a rod-side chamber 26*r* of the arm cylinder 26.

The arm merging valve 57 is interposed between the third pump 33 and the arm cylinder 26 and configured to be opened only when a pilot pressure output by the arm operation device 46 exceeds a predetermined pressure, thereby permitting the hydraulic oil discharged by the third pump 32 to be merged into the hydraulic oil supplied from the second pump 32 into the arm cylinder 26.

Specifically, the arm merging valve 57 according to the present embodiment is formed of a three-position pilot-controlled selector valve having a pair of pilot ports 57*a*, 57*b* as shown in FIG. 4. The arm merging valve 57 has a merging prevention position shown in the center of the figure and an extension merging permission position and a contraction merging permission position which are shown on respective right and left sides of the merging prevention position. When a pilot pressure input to the pilot ports 57*a*, 57*b* is equal to or less than a predetermined pressure (a pilot pressure corresponding to an arm-speed-increase-start operation amount which is set in advance as an amount of the operation applied to the arm lever 46*a* and is larger than the arm start operation amount and), the arm merging valve 57 is kept in the neutral position, thereby blocking the third pump 33 and the arm cylinder 26 from each other and forming an oil path for letting the hydraulic oil, which is discharged by the third pump 33, into the tank. When a pilot pressure exceeding the arm-speed-increase-start pilot pressure is input to the pilot port 57*a*, the arm merging valve 57 is shifted to the extension merging permission position to form an oil path that permits the hydraulic oil, which is discharged by the third pump 33, to be merged into the hydraulic oil supplied from the second pump 32 into the head-side chamber 26*h* of the arm cylinder 26. When a pilot pressure exceeding the arm-speed-increase-start pilot pressure is input to the pilot port 57*b*, the arm merging valve 57 is shifted to the contraction merging permission position to form an oil path that permits the hydraulic oil, which is discharged by the third pump 33, to be merged into the hydraulic oil supplied from the second pump 32 into the rod-side chamber 26*r* of the arm cylinder 26.

The remote control valve 46*b* for the arm has an arm retracting output port and an arm pushing output port. The remote control valve 46*b* for the arm is configured to output a pilot pressure having a magnitude corresponding to the operation amount from the arm retracting output port when the arm lever 46*a* is operated in the arm retracting direction, and also configured to output a pilot pressure having a magnitude corresponding to the operation amount from the arm pushing output port when the arm lever 46*a* is operated in the arm pushing direction. The arm retracting output port is connected to the pilot port 56*a* of the arm control valve 56 through a pilot line 47A for arm retracting control and also connected to the pilot port 57*a* of the arm merging valve 57 through a pilot line 47C for arm retracting merging, the pilot line 47C branched off from the pilot line 47A for arm retracting control. Meanwhile, the arm pushing output port is connected to the pilot port 56*b* of the arm control valve 56 through a pilot line 47B for arm pushing control and also connected to the pilot port 57*a* of the arm merging valve 57 through a pilot line 47D for arm pushing merging, the pilot line 47D branched off from the pilot line 47B for arm pushing control.

Thus, the remote control valve 46*b* for the arm and the pilot lines 47C and 47D for arm retracting and pushing merging constitute a control section that operates the arm merging valve 57 in response to the operation applied to the arm lever 46*a*.

The bucket control valve 58 is interposed between the first pump 31 and the bucket cylinder 28 and configured to be opened upon receiving the input of a pilot pressure output by the bucket operation device 48 to thereby control the supply of the hydraulic oil from the first pump 31 to the bucket cylinder 28. The bucket cylinder 28 can be formed of, for example, a three-position pilot-controlled hydraulic selector valve similarly to the boom control valve 54 and the arm control valve 56 which are shown in FIG. 3 and FIG. 4, respectively.

The straight traveling valve 50 is configured to provide mutual connection of the discharge path of the first pump 31 and the discharge path of the second pump 32 when left and right traveling motors connected to the respective first and second pumps 31 and 32 are driven, thereby ensuring straight traveling, while not being a necessary component in the present invention. The straight traveling valve 50 according to the present embodiment can be also used as a bucket merging valve switchable between a state of preventing the hydraulic oil discharged from the second pump 32 from being merged into the hydraulic oil supplied from the first pump 31 to the bucket cylinder 28 and a state of permitting the hydraulic oils to be merged to cause the second pump 32 to function as a pump for bucket speed increase (pump for second speed of the bucket).

Figure 5:
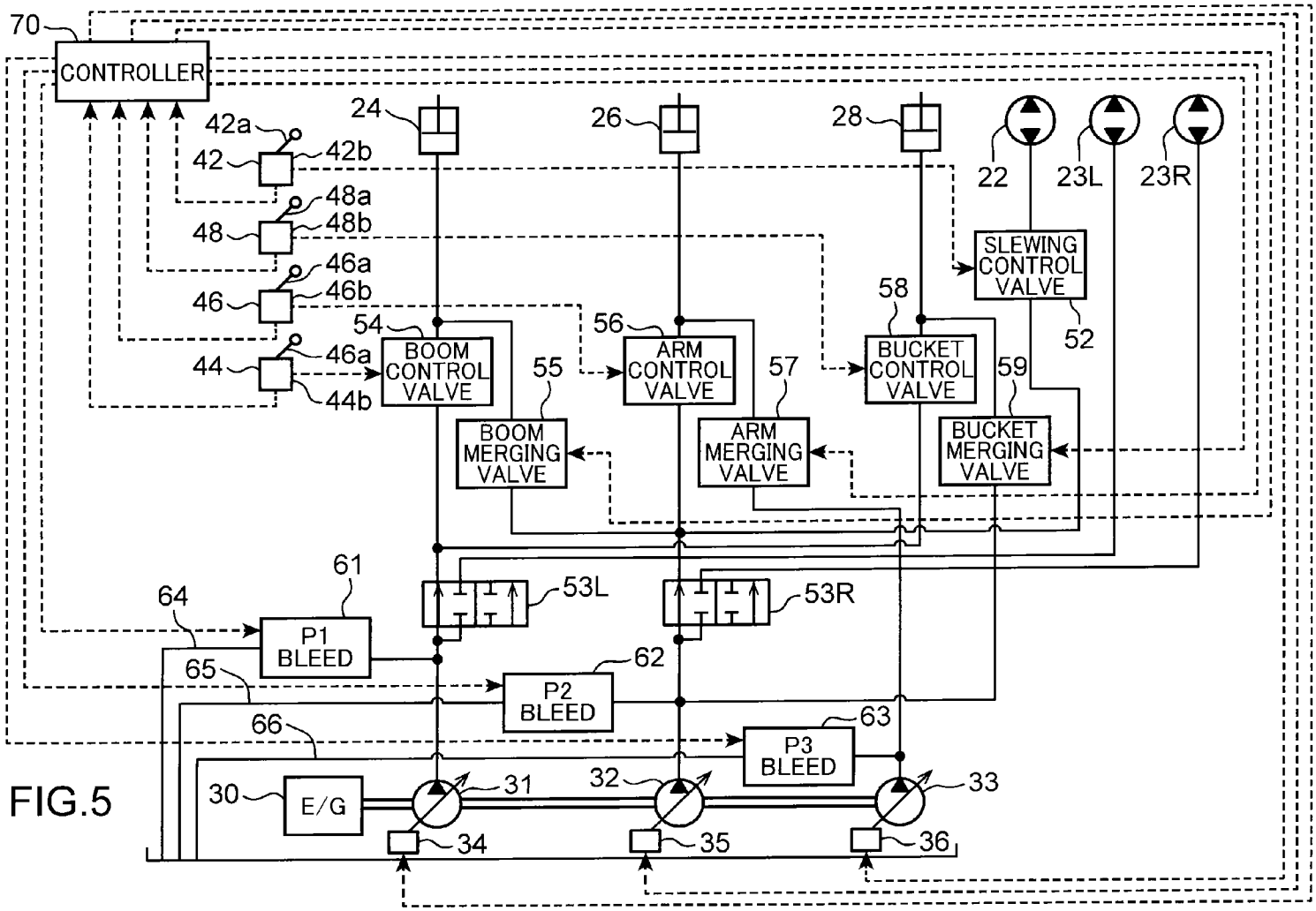
FIG. 5 is a circuit diagram showing a variation example relating to bucket merging in the first embodiment.

Regarding the aforementioned traveling control, the first and second pumps 31, 32 may be connected to a left traveling motor 23L and a right traveling motor 23R through respective separated left traveling control valve 53L and right traveling control valve 53R, as shown in FIG. 5. In this case, there may be added a dedicated bucket merging valve 59 interposed between the second pump 32 and the bucket cylinder 28 as shown in FIG. 5, if necessary.

Figure 9:
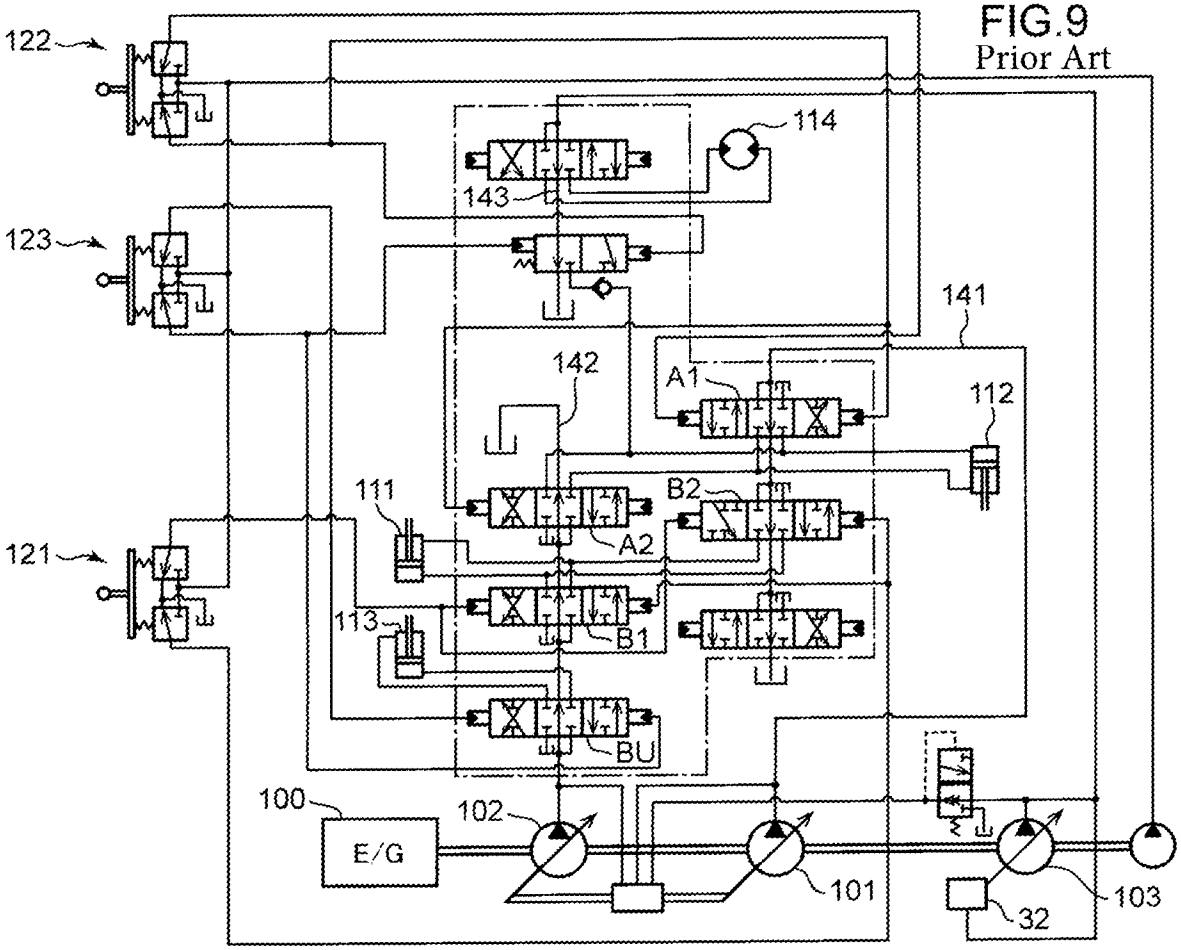
FIG.9 Prior Art
FIG. 9 shows a hydraulic circuit installed at the conventional hydraulic shovel.

For the sake of convenience, FIG. 2 is drawn so that the first pump 31 is connected to the boom control valve 54 and the bucket control valve 58 only through a parallel line while the second pump 32 is connected to the boom merging valve 55, the arm control valve 56, and the slewing control valve 52 only through a parallel line; however, the present invention does not exclude a tandem arrangement of control valves sharing a common hydraulic pump on a center bypass line, for example, similarly to the circuit shown in FIG. 9. For example, the hydraulic circuit shown in FIG. 2 may include a center bypass line running from the discharge port of the first pump 31 thereof to the tank, the boom control valve 54 and the bucket control valve 58 being arranged in tandem on the center bypass line. Also in this arrangement, the two control valves 54, 58 can be connected in parallel to the first pump 31 by adding a parallel line branched off from the center bypass line at a position upstream of the upstream control valve from among the two control valves 54, 58 to reach the inlet port of the downstream control valve.

The hydraulic circuit shown in FIG. 2 includes a first bleed-off passage 64, a second bleed-off passage 65, and a third bleed-off passage 66. The first bleed-off passage 64 is a passage for letting the hydraulic oil discharged by the first pump 31 to the tank so as to bypass the boom cylinder 24 and the bucket cylinder 28 (in FIG. 2, at a position upstream of the boom control valve 54 and the bucket control valve 58). The second bleed-off passage 65 is a passage for letting the hydraulic oil discharged by the second pump 32 to the tank so as to bypass the boom cylinder 24, the arm cylinder 26, and the slewing motor 22 (in FIG. 2, at a position upstream of the control valves 54, 58, 52). The third bleed-off passage 66 is a passage for letting the hydraulic oil discharged by the third pump 33 to the tank so as to bypass the arm cylinder 26 (in FIG. 2, at a position upstream of the arm merging valve 57).

The first, second, and third bleed-off passages 64, 65, 66 are provided with respective first, second, and third bleed-off valves 61, 62, 63. The bleed-off valves 61, 62, 63 are formed of respective two-position pilot-controlled selector valves having respective pilot ports 61*a*, 62*a*, 63*a* as shown in FIGS. 3 and 4. The bleed-off valves 61 to 63 are configured to be kept in their respective closed positions for blocking the bleed-off passages 64 to 66, respectively, when a pilot pressure is not supplied to the respective pilot ports thereof, and configured to be opened as the pilot pressure is supplied to the pilot ports.

In the present embodiment, there are interposed solenoid proportional pressure-reduction valves 71, 72, 73 are interposed between the pilot ports 61*a*, 62*a*, 63*a* of the bleed-off valves 61 to 63 and a pilot hydraulic source (not shown in the figures) for inputting a pilot pressure thereto, respectively. Each of the solenoid proportional pressure-reduction valves 71, 72, 73 is configured to be opened upon receiving a command signal input to permit the pilot pressure proportional to the command signal to be input to the corresponding pilot port.

This hydraulic circuit is provided with a controller 70 as shown in FIGS. 2 to 4. The controller 70 includes a control circuit and constitutes a control section that adjusts respective displacement volumes of the first to third pumps 31 to 33 and the opening areas of the bleed-off valves 61 to 63 in response to the directions and the amounts of the respective operations applied to the operation levers in the operation devices 42, 44, 46, 48. Specifically, the controller 70 performs the following operations. The controller 70 takes in information relating to the lever operation amount of the remote control valves through a pilot pressure sensor provided in the pilot line connected to the remote control valves, or through a potentiometer provided in each remote control valve. The controller 70 inputs command signals to the regulators 34 to 36, respectively, to control respective displacement volumes of the first to third pumps 31 to 33, on the basis of the information that has been taken in. In addition, the controller 70 controls the respective opening areas of the bleed-off valves 61 to 63 by inputting the command signals to the solenoid proportional pressure-reduction valves 71 to 73.

Next will be described the action of the hydraulic shovel.

Upon application of an operation to any one operation lever of the operation devices 42, 44, 46, 48 in the circuit shown in FIG. 2, the remote control valve corresponding to the operated lever outputs a pilot pressure, which opens the control valve corresponding to the remote control valve in the direction corresponding to the direction of the operation applied to the lever, thus allowing hydraulic oil to be supplied to the hydraulic actuator corresponding to the control valve. Furthermore, regarding the operation levers other than the slewing lever, the speed increase valve corresponding to the operation lever starts moving in the opening direction at a point of time when an amount of the operation applied to the operation lever exceeds the preset speed increase start operation amount, thus enabling the corresponding hydraulic actuator to be driven so as to increase the speed thereof.

For example, upon application of an operation to the arm lever 46*a*, which is the operation lever of the arm operation device 46 shown in FIG. 4, in the arm retracting direction, a pilot pressure having a magnitude corresponding to the amount of the operation applied to the arm lever is input to the pilot port 56*a* of the arm control valve 56 and the pilot port 57*a* of the arm merging valve 57. This initially causes the arm control valve 56 to be shifted from the neutral position thereof to the extension operation position on the left side in FIG. 4 to form an oil path for leading the hydraulic oil discharged from the second pump 32 to the head-side chamber 26*h* of the arm cylinder 26. The arm cylinder 26 is thereby operated in the extension direction, actuating the arm 20 in the retracting direction (direction of retracting the bucket 21). Furthermore, when the amount of the operation applied to the arm lever 46*a* exceeds the preset arm-speed-increase-start operation amount to make the pilot pressure input to the pilot port 57*a* of the arm merging valve 57 exceed the arm-speed-increase-start pilot pressure corresponding to the arm-speed-increase-start operation amount, the arm merging valve 57 is also shifted from the neutral position thereof to the extension merging permission position on the left side in FIG. 4 to form the oil path permitting the hydraulic oil supplied from the third pump 33 to be merged into the hydraulic oil supplied from the second pump 32 to the head-side chamber 26*h*. This merging increases the drive speed of the arm 20 in the retracting direction.

In the case of a complex operation which is a simultaneous performance of both of applying an operation to the arm lever 46*a* in the arm retracting direction and applying an operation to the boom lever 44*a* in the boom raising direction to retract the bucket 21 above or on the ground, performed is a supply of hydraulic oil from the first pump 31 into the head-side chamber 24*h* of the boom cylinder 24 through opening the boom control valve 54 shown in FIG. 3, in addition to supply of hydraulic oil to the head-side chamber 26*h* of the arm cylinder 26. This generates a possibility that the drive load of the arm cylinder 26 for the arm retracting operation is significantly reduced compared with the drive load of the boom cylinder 24 for the boom raising operation. However, even though the drive load of the arm cylinder 26 is small, there is no risk of biasing the flow rate of hydraulic oil to the arm cylinder 26 to drop the drive speed of the boom cylinder 24, because the first pump 31 for supplying the hydraulic oil to the boom cylinder 24 and the second and third pumps 32, 33 for supplying the hydraulic oil to the arm cylinder 26 are independently separate pumps from each other. Both of the boom cylinder 24 and the arm cylinder 26, therefore, can be driven at respective adequate speeds corresponding to the operation amounts of the boom lever 44*a* and the arm lever 46*a*.

For example, in the case of simultaneous performance of the aforementioned arm-retracting-speed increase drive and boom raising drive in the conventional circuit shown in FIG. 9, that is, in the case of simultaneous performance of operating both of the first boom control valve B1 and the second arm control valve A2 shown in FIG. 9 to open them, the tandem arrangement of the valves B1 and A2 may prevent hydraulic oil from being supplied to the second arm control valve A2, which is located downstream, at a sufficient flow rate, to thus slow the motion of the arm cylinder 112. Besides, in the case of providing a parallel line branched off from the second center bypass line 142 upstream of the first boom control valve B1 (shown in the same figure) to reach the second arm control valve A2 so as to bypass the first boom control valve B1 in order to avoid the above-described inconvenience, the flow rate of the hydraulic oil can be biased to the second arm control valve A2 and the arm cylinder 112 when the drive load of the arm cylinder 112 is significantly small compared with the drive load of the boom cylinder 111, as described hereinabove, to thereby conversely hinder the boom cylinder 111 from adequate motion. In contrast, the circuit shown in FIG. 2, where the primary drive and speed increase of the arm cylinder 26 are assigned to the second and third pumps 32 and 33, respectively, and the primary drive of the boom cylinder 24 is assigned to the first pump 31, can ensure driving the cylinders 24 and 26 at respective adequate speeds.

Although the circuit shown in FIG. 2 includes the connection of the second pump 32 to both of the arm control valve 56 and the boom merging valve 55 in parallel to use the second pump 32 for both of the arm primary drive (first speed of the arm) and the boom speed increase (second boom speed), the boom cylinder 24 cannot be hindered from adequate motion even when the supply of hydraulic oil discharged by the second pump 32 is biased to the arm cylinder 26 whose drive load is small. That is because such operation that the drive load of the arm 20 becomes significantly small compared with the drive load of the boom 18, for example, such operation as to retract the bucket above or on the ground by a combination of boom raising operation and arm retracting operation as described hereinabove, requires no high speed for the boom 18 and, therefore, does not require the second pump 32 to function as a pump for boom speed increase (second boom speed). Besides, although the first pump 31 shown in FIG. 2 is connected in parallel to the arm merging valve 57 and the bucket control valve 58 for the use thereof for both of the arm speed increase (second arm speed) and the bucket drive, this also causes no significant decrease in the supply flow rate of the hydraulic oil from the first pump 31 to the arm 20 because driving of the bucket 21 is little performed at the initial stage of operation.

Thus, the combination of the first to third pumps 31 to 33 shown in FIG. 2 and the control and merging valves is so rational as to realize driving the hydraulic actuators at respective suitable speeds in various complex operations.

In addition, setting the third pump 33 as a pump dedicated to arm speed increase in the circuit shown in FIG. 2 has the advantage of allowing a small pump with a low displacement volume to be used as the third pump 33 and enabling the hydraulic oil supply flow rate for arm speed increase to be controlled only through adjusting the displacement volume of the third pump 33, to thereby increase the degree of freedom in setting the opening characteristics of the arm merging valve 57 and the third bleed-off valve 63. Furthermore, setting the opening characteristics makes it possible to minimize the energy loss caused by the discharge of the hydraulic oil by the third pump 33 when no arm speed increase is performed and also to minimize the pressure loss in the hydraulic oil discharged by the third pump 33 when the arm speed increase is performed.

Specifically, since each of the first pump 31 and the second pump 32 is used for driving a plurality of hydraulic actuators, the speed of the hydraulic actuators connected to the pumps cannot be controlled only through adjusting the displacement volume of the pumps; therefore, respective meter-in opening characteristics of the control valves connected to those pumps 31, 32 have to be set so as to lead the hydraulic oil to the hydraulic actuators at a flow rate that increases with the increase in the pilot pressure input to the control valves (in other words, with the increase in an amount of the operation applied to the operation levers operated for the control valves). In contrast, since the third pump 33 is used only for the arm speed increase, the supply flow rate of the hydraulic oil for arm speed increase can be controlled only through adjusting the displacement volume of the third pump 33, resulting in the advantage of allowing the meter-in opening characteristic of the arm merging valve 57 relating to the third pump 33 or the opening characteristic of the third bleed-off valve 63 to be set, for example, to an ON-OFF characteristic.

Figure 6:
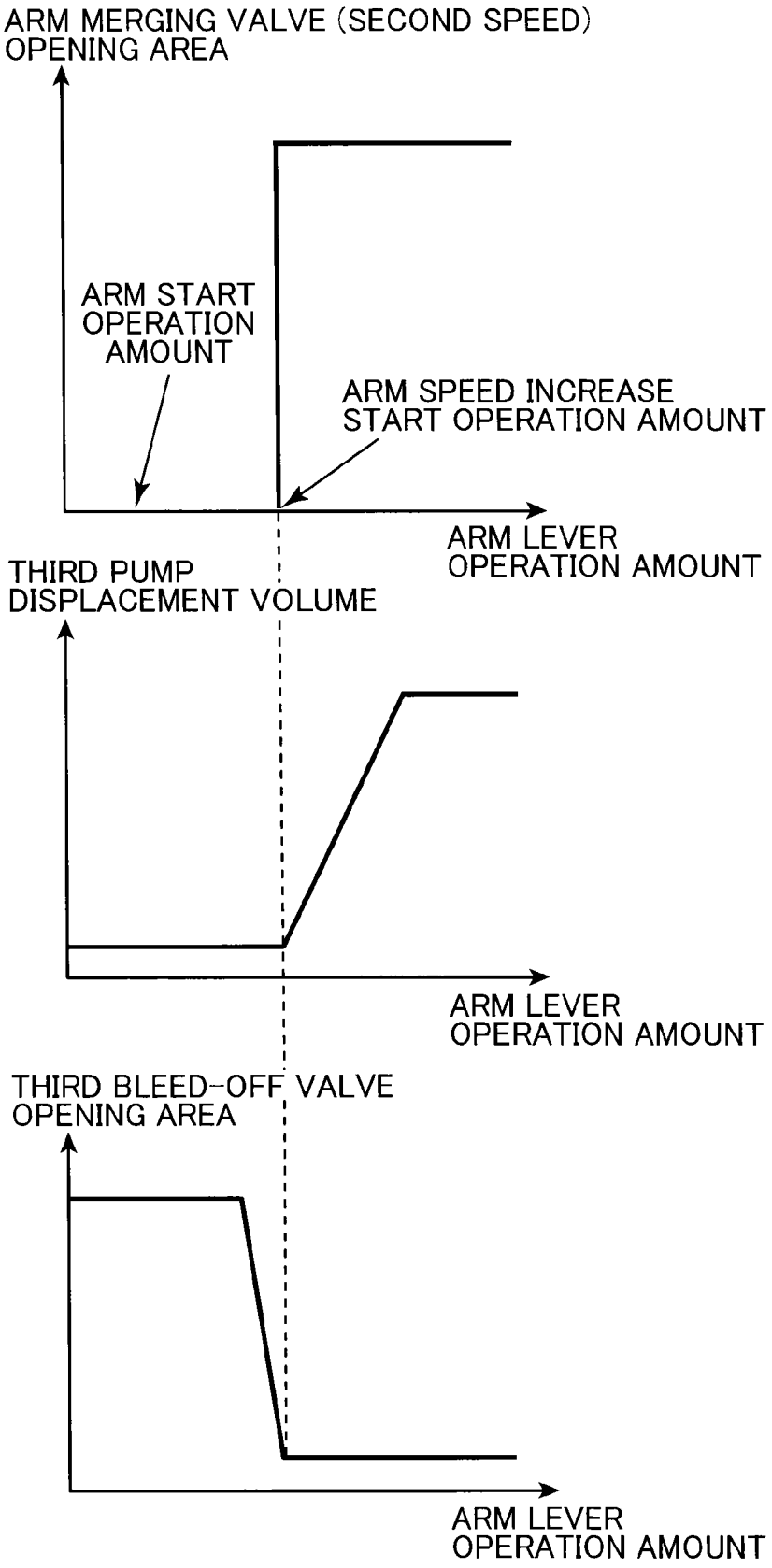
FIG. 6 shows graphs representing the property of the meter-in opening area of the arm merging valve included in the hydraulic circuit with respect to the arm lever operation amount and also representing the displacement volume of the third pump and the opening area of the third bleed-off valve that are controlled on the basis of the arm lever operation amount.

FIG. 6 shows at example allowing both of the energy loss and the pressure loss to be reduced by utilization of the abovementioned advantage. In the figure, the meter-in opening characteristic of the arm merging valve 57, that is, the valve for the second arm speed, is set so as to be kept minimized (0 in the figure) until the arm lever operation amount reaches the preset arm-speed-increase-start operation amount, and so as to be maximized when the arm lever operation amount exceeds the arm-speed-increase-start operation amount. On the other hand, the displacement volume of the third pump 33 adjusted by the controller 70 is set so as to be kept at a minimum value in a region where the arm lever operation amount is equal to or less than the arm-speed-increase-start operation amount and so as to be increased with the increase in the arm lever operation amount in a region where the arm-speed-increase-start operation amount is exceeded. Besides, the opening characteristic of the third bleed-off valve 63 adjusted by the controller 70 is set so as to be maximized over the substantially entire region where the arm lever operation amount is equal to or less than the arm-speed-increase-start operation amount and so as to be minimized in a region where the arm-speed-increase-start operation amount is exceeded.

According to this example, until the amount of the operation applied to the arm lever 46*a* reaches the arm-speed-increase-start operation amount, that is, as long as the arm speed increase is not required, closing the arm merging valve 57 and minimizing the displacement volume of the third pump 33 (preferably) while maximizing the opening area of the third bleed-off valve 63 allows the energy loss caused by the discharge of the hydraulic oil by the third pump 33 to be suppressed at a minimum. On the other hand, in a region where the amount of the operation applied to the arm lever 46*a* exceeds the arm-speed-increase-start operation amount, maximizing the meter-in opening of the arm merging valve 57 and minimizing the opening area of the third bleed-off valve 63 allows the pressure loss to be suppressed at a minimum, while adjusting the displacement volume of the third pump 33 allows the flow rate of the hydraulic oil for speed increase which is supplied from the third pump 33 to the arm cylinder 26 to be adequately controlled.

It is also possible to directly input a pilot pressure output by the arm operation device 46 to the pilot port 63*a* of the third bleed-off valve 63. In this case, preferable is to set the opening characteristic of the third bleed-off valve 63 (the characteristic of the opening area with respect to the stroke amount of the third bleed-off valve 63) as indicated by the graph in the lowermost section in FIG. 6. The "control section" according to the present invention in this case includes a bleed-off pilot line that introduces the pilot pressure output by the arm remote control valve 46*b* into the pilot port 63*a*.

Figure 7:
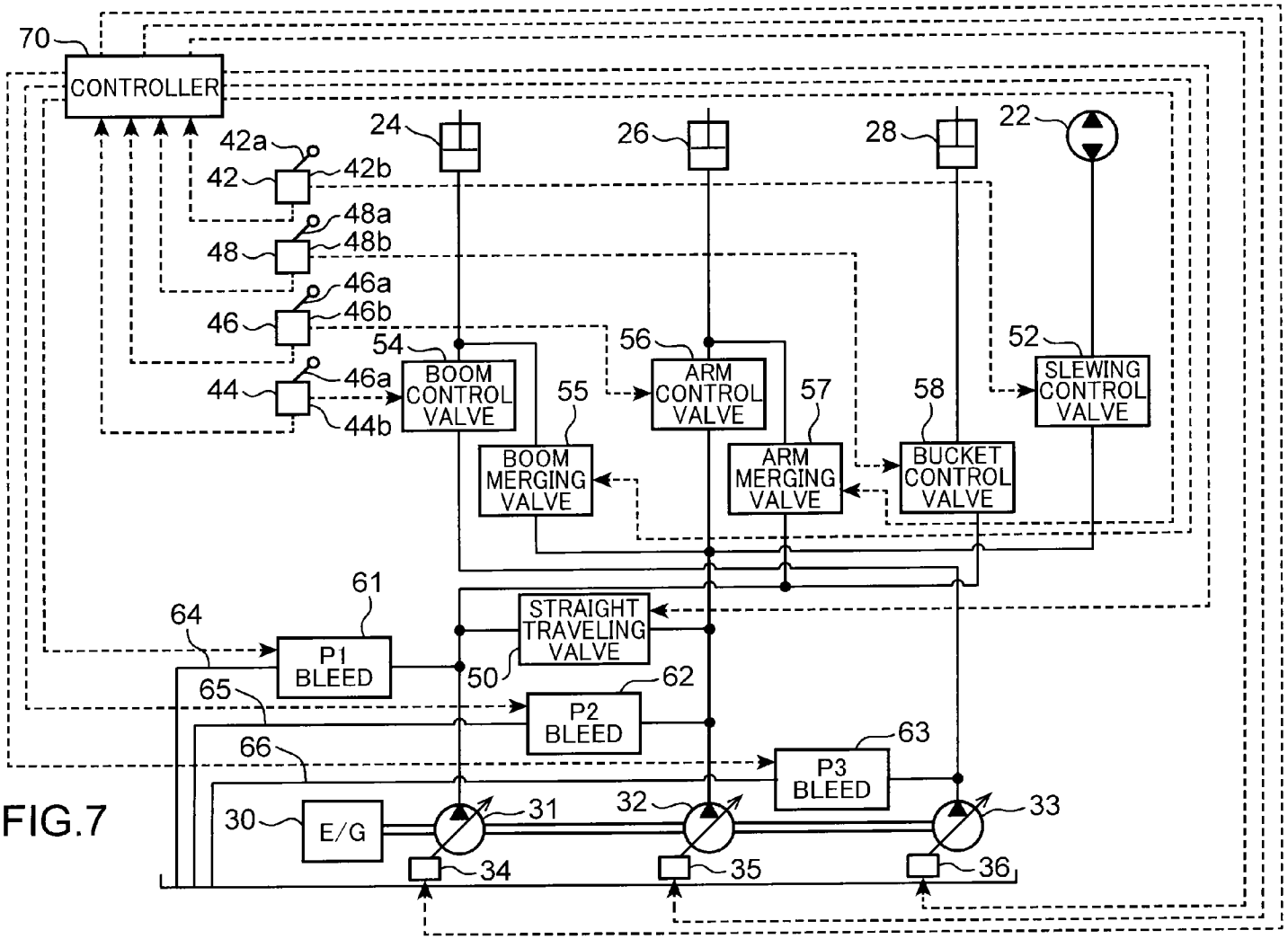
FIG. 7 shows a hydraulic circuit installed on the hydraulic shovel according to the second embodiment of the present invention.

FIG. 7 shows a hydraulic circuit instilled on a hydraulic shovel according to the second embodiment of the present invention. This hydraulic circuit is the same as the hydraulic circuit shown in FIG. 2, except for the below-described differences.

Difference 1: the first pump 31 in the hydraulic circuit shown in FIG. 2 functions as a pump for boom primary drive (boom first speed) and a pump for bucket primary drive, whereas the first pump 31 in the hydraulic circuit shown in FIG. 7 functions as a pump for arm speed increase (second arm speed) and a pump for bucket primary drive. Specifically, the first pump 31 is connected in parallel to the arm cylinder 26 and the bucket cylinder 28, and the arm merging valve 57 (the control valve identical to the arm merging valve 57 shown in FIG. 4) is interposed between the first pump 31 and the arm cylinder 26.

Difference 2: the third pump 33 in the hydraulic circuit shown in FIG. 2 functions as a pump for arm speed increase (second arm speed) and a pump for bucket primary drive, whereas the third pump 33 in the hydraulic circuit shown in FIG. 7 functions as a pump for boom primary drive (boom first speed). Specifically, the third pump 33 is connected to the boom cylinder 24, and the boom control valve 54 (control valve identical to the boom control valve 54 shown in FIG. 3) is interposed between the third pump 33 and the boom cylinder 24.

Also in the circuit shown in FIG. 7, upon the application of an operation to the arm lever 46*a* which is the operation lever of the arm operation device 46 in the arm retracting direction, the pilot pressure having a magnitude corresponding to the operation is input to respective pilot ports of the arm control valve 56 and the arm merging valve 57. This causes, initially, the arm control valve 56 to be opened to form an oil path that leads the hydraulic oil, which is discharged from the second pump 32, to the head-side chamber 26*h* (FIG. 4) of the arm cylinder, thus moving the arm cylinder 26 in the extension direction. Furthermore, when the amount of the operation applied to the arm lever 46*a* exceeds the preset arm-speed-increase-start operation amount, the arm merging valve 57 is also opened to form an oil path that permits the hydraulic oil discharged from the first pump 31 to be merged into the hydraulic oil supplied from the second pump 32 into the head-side chamber 26*h*. This merging increases the speed at which the arm 20 is driven in the retracting direction.

In this situation, if a complex operation which is a simultaneous performance of applying the arm lever in the arm retracting direction and applying an operation to the boom lever in the boom raising direction is made to retract the bucket 21 above or on the ground, the boom control valve 54 is opened to allow hydraulic oil from the third pump 33 to be supplied to the head-side chamber 24*h* of the boom cylinder 24 (FIG. 3), in addition to the supply of the hydraulic oil to the head-side chamber 26*h* of the arm cylinder 26. At this time, the drive load of the arm cylinder 26 for the arm retracting operation can be significantly small than the drive load of the boom cylinder 24 for the boom raising operation; however, also in the circuit shown in FIG. 7, there is no possibility of biasing the flow rate of the hydraulic oil to the arm cylinder 26 to thus drop the drive speed of the boom cylinder 24, even though the drive load of the arm cylinder 26 is small, because the third pump 33 that supplies the hydraulic oil to the boom cylinder 24 and the second and first pumps 32, 31 that supply the hydraulic oil to the arm cylinder 26 are also independently separate pumps from each other. Hence, similarly to the circuit shown in FIG. 2, both of the boom cylinder 24 and the arm cylinder 26 can be driven at respective adequate speeds corresponding to respective amounts of the operations applied to the boom lever 44*a* and the arm lever 46*a*.

As above-described about the circuit shown in FIG. 2, the parallel connection of the second pump 32 in parallel to the arm control valve 56 and the boom merging valve 55 in order to use the second pump 32 for both of the arm primary drive (first speed of the arm) and the boom speed increase (second boom speed) cannot hinder the boom cylinder from normal motion, for the second pump 32 is not required to function as a pump for boom speed increase (second boom speed) in the operation of retracting the bucket above or on the ground by a combination of boom raising operation and arm retracting operation. It is also similar to the circuit shown in FIG. 2 that the connection of the first pump 31 in parallel to the boom control valve 54 and the bucket control valve 58 in order to use the first pump 31 for both of the boom primary drive (boom first speed) and bucket drive, causes no significant decrease in the supply flow rate of the hydraulic oil from the first pump 31 to the boom 18, for the bucket 21 is little driven at the initial stage of operation.

Furthermore, also in the circuit shown in FIG. 7, setting the third pump 33 as a pump dedicated to boom primary drive generates the advantage of allowing a small pump with a low displacement volume to be used as the third pump 33 and allowing the hydraulic oil supply flow rate for boom primary drive to be controlled only through adjusting the displacement volume of the third pump 33, to thereby increase the degree of freedom in setting the opening characteristics of the boom control valve 54 and the third bleed-off valve 63. Then, through setting the opening characteristics, it is possible to minimize the energy loss caused by the discharge of the hydraulic oil by the third pump 33 when no boom primary drive is performed and also to minimize the pressure loss of the hydraulic oil discharged by the third pump 33 when the boom primary drive is performed.

Figure 8:
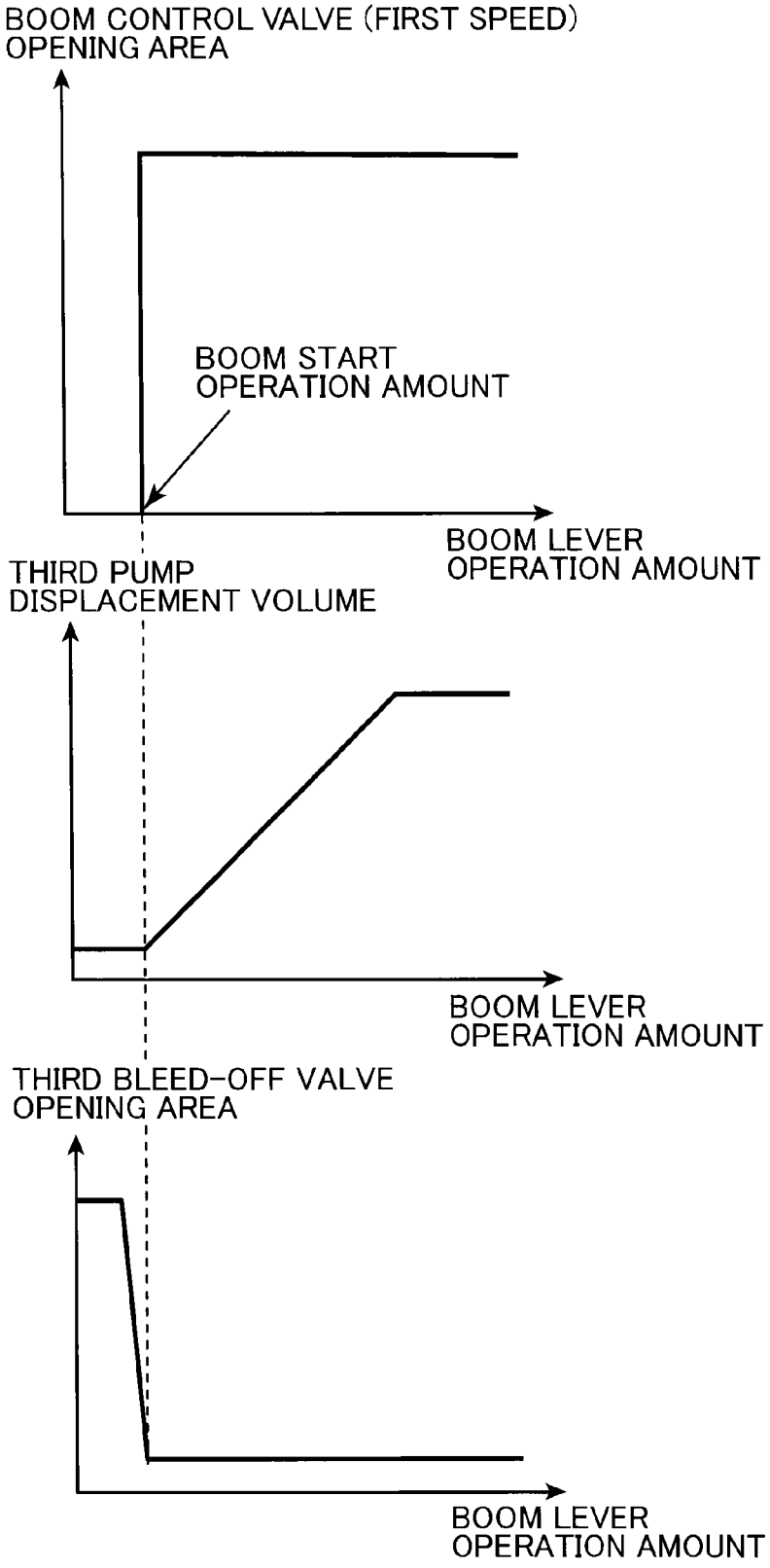
FIG. 8 shows graphs representing the property of the meter-in opening area of the boom control valve included in the hydraulic circuit with respect to the boom lever operation amount and also representing the displacement volume of the third pump and the opening area of the third bleed-off valve that are controlled on the basis of the boom lever operation amount.

The example thereof is shown in FIG. 8, where the meter-in opening characteristic of the boom control valve 54, that is, the valve for the boom first speed, is set so as to be kept at a minimum (0 in the figure) until the boom lever operation amount reaches the preset boom start operation amount and so as to be at a maximum when the boom lever operation amount exceeds the boom start operation amount. On the other hand, the displacement volume of the third pump 33 controlled by the controller 70 is set so as to be kept a minimum valve in a region where the boom lever operation amount is equal to or less than the boom start operation amount and so as to increase with the increase in the boom lever operation amount in a region where the boom start operation amount is exceeded. Besides, the opening characteristic of the third bleed-off valve 63 which is controlled by the controller 70 is set so as to be at a maximum over almost of the region where the boom lever operation amount is equal to or less than the boom start operation amount and so as to be at a minimum in a region where the boom start operation amount is exceeded.

According to this example, until an amount of the operation applied to the boom lever 44*a* reaches the boom start operation amount, that is, as long as substantially no operation is applied to the boom lever 44*a*, closing the boom control valve 54 and minimizing the displacement volume of the third pump 33 (preferably) while maximizing the opening area of the third bleed-off valve 63 allows the energy loss caused by the discharge of the hydraulic oil by the third pump 33 to be suppressed at a minimum. On the other hand, in a region where an amount of the operation applied to the boom lever 44*a* exceeds the boom start operation amount, the flow rate of the hydraulic oil for primary drive which is supplied from the third pump 33 to the boom cylinder 24 can be suitably controlled through operating the displacement volume of the third pump 33 while reducing the pressure loss to a minimum through maximizing the meter-in opening of the boom control valve 54 and minimizing the opening area of the third bleed-off valve 63.

In the second embodiment, the pilot pressure output by the boom operation device 44 may be directly input to the pilot port 63*a* of the third bleed-off valve 63 shown in FIG. 4. In this case, it is preferable to set the opening characteristic of the third bleed-off valve 63 (the characteristic of the opening area with respect to the stroke amount of the third bleed-off valve 63) as indicated by the graph shown in the lowermost section in FIG. 8. In this case, the "control section" according to the present invention includes a bleed-off pilot line that introduces the pilot pressure output by the boom remote control valve 46*b* into the pilot port 63*a*.

As described hereinabove, the present invention provides the following first and second hydraulic shovels capable of allowing the boom, arm, and bucket to be moved at suitable speeds even with a complex operation thereof, without a significant pressure loss, sharing common technical features.

The first hydraulic shovel includes: a base; a boom mounted on the base so as to be raised and lowered; an arm rotatably coupled to a distal end of the boom; a bucket rotatably coupled to a distal end of the arm; a boom hydraulic actuator that is operated so as to raise and lower the boom by receiving supply of hydraulic oil; an arm hydraulic actuator that is operated so as to rotate the arm relatively to the boom by receiving supply of hydraulic oil; a bucket hydraulic actuator that is operated so as to rotate the bucket relatively to the arm by receiving supply of hydraulic oil; a first pump that is formed of a hydraulic pump discharging a hydraulic oil, the first pump connected in parallel to the boom hydraulic actuator and the bucket hydraulic actuator; a second pump that is formed of a hydraulic pump discharging a hydraulic oil, the second pump connected in parallel to the arm hydraulic actuator and the boom hydraulic actuator; a third pump that is formed of a hydraulic pump discharging a hydraulic oil, the third pump connected to the arm hydraulic actuator; a boom operation member to which an operation for moving the boom hydraulic actuator is applied; an arm operation member to which an operation for moving the arm hydraulic actuator is applied; a bucket operation member to which an operation for moving the bucket hydraulic actuator is applied; a boom control valve interposed between the first pump and the boom hydraulic actuator and configured to be opened in response to the operation applied to the boom operation member to control the supply of the hydraulic oil from the first pump to the boom hydraulic actuator; an arm control valve interposed between the second pump and the arm hydraulic actuator and configured to be opened in response to the operation applied to the arm operation member to control the supply of the hydraulic oil from the second pump to the arm hydraulic actuator; a bucket control valve interposed between the first pump and the bucket hydraulic actuator and configured to be opened in response to the operation applied to the bucket operation member to control the supply of the hydraulic oil from the first pump to the bucket hydraulic actuator; a boom merging valve interposed between the second pump and the boom hydraulic actuator and configured to be opened only when an amount of the operation applied to the boom operation member exceeds a preset boom-speed-increase-start operation amount to permit the hydraulic oil discharged by the second pump to be merged into the hydraulic oil supplied from the first pump to the boom hydraulic actuator; and an arm merging valve interposed between the third pump and the arm hydraulic actuator and configured to be opened only when an amount of the operation applied to the arm operation member exceeds a preset arm-speed-increase-start operation amount to permit the hydraulic oil discharged by the third pump to be merged into the hydraulic oil supplied from the second pump to the arm hydraulic actuator.

The second hydraulic shovel includes: a base; a boom mounted on the base so as to be raised and lowered; an arm rotatably coupled to a distal end of the boom; a bucket rotatably coupled to a distal end of the arm; a boom hydraulic actuator that is operated so as to raise and lower the boom by receiving supply of hydraulic oil; an arm hydraulic actuator that is operated so as to rotate the arm relatively to the boom by receiving supply of hydraulic oil; a bucket hydraulic actuator that is operated so as to rotate the bucket relative to the arm by receiving supply of hydraulic oil; a first pump that is formed of a hydraulic pump discharging a hydraulic oil and connected in parallel to the arm hydraulic actuator and the bucket hydraulic actuator; a second pump that is formed of a hydraulic pump discharging a hydraulic oil and connected in parallel to the arm hydraulic actuator and the boom hydraulic actuator; a third pump that is formed of a hydraulic pump discharging a hydraulic oil and connected to the boom hydraulic actuator; a boom operation member to which an operation for moving the boom hydraulic actuator is applied; an arm operation member to which an operation for moving the arm hydraulic actuator is applied; a bucket operation member to which an operation for moving the bucket hydraulic actuator is applied; a boom control valve interposed between the third pump and the boom hydraulic actuator and configured to be opened to control the supply of the hydraulic oil from the third pump to the boom hydraulic actuator through opening in response to the operation of the boom operation member; an arm control valve interposed between the second pump and the arm hydraulic actuator and configured to be opened to control the supply of the hydraulic oil from the second pump to the arm hydraulic actuator through opening in response to the operation applied to the arm operation member; a bucket control valve interposed between the first pump and the bucket hydraulic actuator and configured to be opened to control the supply of the hydraulic oil from the first pump to the bucket hydraulic actuator through opening in response to the operation applied to the bucket operation member; a boom merging valve interposed between the second pump and the boom hydraulic actuator and configured to be opened only when an amount of the operation applied to the boom operation member exceeds a preset boom-speed-increase-start operation amount to permit the hydraulic oil discharged by the second pump to be merged into the hydraulic oil supplied from the third pump to the boom hydraulic actuator; and an arm merging valve interposed between the first pump and the arm hydraulic actuator and configured to be opened only when an amount of the operation applied to the arm operation member exceeds a preset arm-speed-increase-start operation amount to permit the hydraulic oil discharged by the first pump to be merged into the hydraulic oil supplied from the second pump to the arm hydraulic actuator.

In summary, the first and second hydraulic shovels in accordance with the present invention have the following common features: (i) the first pump is connected as a bucket drive pump to the bucket hydraulic actuator through the bucket control valve; (ii) the second pump is connected as a boom speed increase pump to the boom hydraulic actuator through the boom merging valve and also connected as an arm primary drive pump to the arm hydraulic actuator through the arm control valve; and further (iii) either one of the first pump and the third pump is connected as a boom primary drive pump to the boom hydraulic actuator through the boom control valve, and the other of the first pump and the third pump is connected as an arm speed increase pump to the arm hydraulic actuator through the arm merging valve.

Summary of the functions of the first to third pumps in the first and second hydraulic shovels is as follows: the first pump functions as a pump either for boom primary drive (the so-called boom first speed) or for arm speed increase (the so-called second arm speed) and for bucket driving; the second pump functions as a pump for boom speed increase (the so-called second boom speed) and for arm primary drive (the so-called first speed of the arm); and the third pump functions as a pump either for arm speed increase (the so-called second arm speed) or for boom primary drive (the so-called boom first speed).

Thus, the hydraulic shovel in accordance with the present invention, having the three independent pumps to which the boom primary drive (boom first speed), arm primary drive (first speed of the arm), and arm speed increase (second arm speed) are assigned, can prevent the flow rate of hydraulic oil supply from being significantly biased to one side when both the arm primary drive and the arm speed increase are performed at the same time, thereby making it possible to supply hydraulic oil at respective adequate flow rate to both the boom and the arm, with no use of a throttle that may involve a large pressure loss.

Although the second pump is used for both the arm primary drive (first speed of the arm) and the boom speed increase (second boom speed), the boom is not hindered from normal motion even when the hydraulic oil discharged by the second pump is biased to the arm whose drive load is small, because a high speed is not required for the boom raising operation and, therefore, the second pump is not required to function as a pump for boom speed increase (second boom speed) in such operation that the drive load on the arm becomes significantly small compared to the drive load on the boom, for example, in the operation of retracting the bucket above or on the ground by a combination of boom raising operation and arm retracting operation. Besides, although the first pump is used for both the arm speed increase (second arm speed) and boom primary drive (boom first speed), the supply flow rate of the hydraulic oil from the first pump to the arm or boom is also not significantly decreased, because the bucket drive is little performed at the initial stage of operation.

According to the present invention, in the case of connecting the first pump the boom hydraulic actuator through the boom control valve and connecting the third pump to the arm hydraulic actuator through the arm merging valve, as the first hydraulic shovel, it is preferred that the third pump is formed of a variable-displacement hydraulic pump, and the hydraulic shovel further includes: a bleed-off passage for letting the hydraulic oil discharged by the third pump to a tank upstream of the arm merging valve; a bleed-off valve provided in the bleed-off passage; and a control section configured to minimize the pump displacement volume of the third pump in a region where an amount of the operation applied to the arm operation member is equal to or less than the arm-speed-increase-start operation amount and configured to maximize a meter-in opening of the arm merging valve and minimize the opening of the bleed-off valve while changing the pump displacement volume of the third pump according to an amount of the operation applied to the arm operation member in a region where an amount of the operation applied to the arm operation member exceeds the arm-speed-increase-start operation amount.

Through minimizing the pump displacement volume of the third pump when an amount of the operation applied to the arm operation member is equal to or less than the arm-speed-increase-start operation amount, the control section can suppress to a minimum the energy loss caused by the discharge of the hydraulic oil from the third pump when the arm speed increase is not required, and, through maximizing the meter-in opening of the arm merging valve and minimizing the opening of the bleed off valve when an amount of the operation applied to the arm operation member exceeds the arm speed increase start amount, the control section can suppress to a minimum the pressure loss in the meter-in opening of the arm merging valve and in the opening of the bleed-off valve. Furthermore, the flow rate of the hydraulic oil supplied from the third pump to the arm hydraulic actuator through the arm merging valve can be controlled through adjusting the displacement volume of the third pump.

More specifically, it is preferred that: each of the arm control valve and the arm merging valve is formed of a pilot-controlled selector valve configured to be operated by input of a pilot pressure; the control section includes an arm remote control valve that outputs an arm pilot pressure corresponding to an amount of the operation applied to the arm operation member and an arm merging pilot line that leads the arm pilot pressure output by the arm remote control valve to the arm merging valve as the pilot pressure thereof; and the meter-in opening of the arm merging valve has such a characteristic as to be at a minimum when the arm pilot pressure is equal to or less than an arm-speed-increase-start pilot pressure corresponding to the arm-speed-increase-start operation amount and as to be at a maximum when the arm pilot pressure exceeds the arm-speed-increase-start pilot pressure. This enables the meter-in opening of the arm merging valve to be adequately controlled only with a simple configuration for leading the arm pilot pressure output by the arm remote control valve to the arm merging valve, with no use of a special control circuit.

Likewise, in the case of connecting the first pump to the arm hydraulic actuator through the arm merging valve and connecting the third pump to the boom hydraulic actuator through the boom control valve, as in the second hydraulic shovel, it is preferred that the third pump is formed of a variable-displacement hydraulic pump and the hydraulic shovel further includes: a bleed-off passage for letting the hydraulic oil discharged by the third pump to a tank upstream of the boom control valve; a bleed-off valve provided in the bleed-off passage; and a control section configured to minimize the pump displacement volume of the third pump in a region where an amount of the operation applied to the boom operation member is equal to or less than a boom start operation amount for starting the boom hydraulic actuator and to maximize the meter-in opening of the boom control valve and minimize the opening of the bleed-off valve in a region where an amount of the operation applied to the boom operation member exceeds the boom start operation amount.

In the hydraulic shovel, the control section minimizes the pump displacement volume of the third pump when an amount of the operation applied to the boom operation member is equal to or less than the boom start operation amount, that is, when substantially no operation is applied to the boom operation member, to thereby allow the energy loss created by the discharge of the hydraulic oil from the third pump when the boom drive is not required to be suppressed to a minimum, and maximizes the meter-in opening of the boom control valve and minimizes the opening of the bleed off valve when the amount of the operation applied to the boom operation member exceeds the boom start operation amount to thereby allow respective pressure losses in the meter-in opening of the boom control valve and in the opening of the bleed-off valve to be suppressed to a minimum.

Specifically, it is preferred that: the boom control valve is formed of a pilot-controlled selector valve configured to be operated by an input of a pilot pressure; the control section includes a boom remote control valve that outputs a boom pilot pressure corresponding to an amount of the operation applied to the boom operation member and a boom control pilot line that leads the boom pilot pressure output by the boom remote control valve to the boom control valve as the pilot pressure thereof; and the meter-in opening of the boom control valve has such a characteristic as to be at a minimum when the boom pilot pressure is equal to or less than a boom start pilot pressure corresponding to the boom start operation amount and as to be at a maximum when the boom pilot pressure exceeds the boom start pilot pressure. This enables the meter-in opening of the boom control valve to be adequately controlled only with a simple configuration for leading the boom pilot pressure output by the boom remote control valve to the boom control valve, with no use of a special control circuit.

The invention claimed is:

1. A hydraulic shovel comprising:

a base;

a boom mounted on the base so as to be raised and lowered;

an arm rotatably coupled to a distal end of the boom;

a bucket rotatably coupled to a distal end of the arm;

a boom hydraulic actuator that is operated so as to raise and lower the boom by receiving supply of hydraulic oil;

an arm hydraulic actuator that is operated so as to rotate the arm relatively to the boom by receiving supply of hydraulic oil;

a bucket hydraulic actuator that is operated so as to rotate the bucket relatively to the arm by receiving supply of hydraulic oil;

a first pump that is formed of a hydraulic pump discharging a hydraulic oil, the first pump connected to only the boom hydraulic actuator and the bucket hydraulic actuator in parallel among a group consisting of the boom hydraulic actuator, the arm hydraulic actuator and the bucket hydraulic actuator;

a second pump that is formed of a hydraulic pump discharging a hydraulic oil, the second pump connected to only the arm hydraulic actuator and the boom hydraulic actuator in parallel among the group consisting of the boom hydraulic actuator, the arm hydraulic actuator and the bucket hydraulic actuator;

a third pump that is formed of a hydraulic pump discharging a hydraulic oil, the third pump connected only to the arm hydraulic actuator among the group consisting of the boom hydraulic actuator, the arm hydraulic actuator and the bucket hydraulic actuator;

a boom operation member to which an operation for moving the boom hydraulic actuator is applied;

an arm operation member to which an operation for moving the arm hydraulic actuator is applied;

a bucket operation member to which an operation for moving the bucket hydraulic actuator is applied;

a boom control valve including a first pilot port and interposed between the first pump and the boom hydraulic actuator and configured to be opened in response to the operation applied to the boom operation member when a pilot pressure exceeding a boom start pilot pressure corresponding to a boom start operation amount which has been set in advance with respect to the operation of the boom operation member is input to the first pilot port to control the supply of the hydraulic oil from the first pump to the boom hydraulic actuator;

an arm control valve including a second pilot port and interposed between the second pump and the arm hydraulic actuator and configured to be opened in response to the operation applied to the arm operation member when a pilot pressure exceeding an arm start pilot pressure corresponding to an arm start operation amount which has been set in advance with respect to the operation of the arm operation member is input to the second pilot port to control the supply of the hydraulic oil from the second pump to the arm hydraulic actuator;

a bucket control valve interposed between the first pump and the bucket hydraulic actuator and configured to be opened in response to the operation applied to the bucket operation member to control the supply of the hydraulic oil from the first pump to the bucket hydraulic actuator;

a boom merging valve interposed between the second pump and the boom hydraulic actuator and configured to be opened only when an amount of the operation applied to the boom operation member exceeds a preset boom-speed-increase-start operation amount larger than the boom start operation amount to permit the hydraulic oil discharged by the second pump to be merged into the hydraulic oil supplied from the first pump to the boom hydraulic actuator; and an arm merging valve interposed between the third pump and the arm hydraulic actuator and configured to be opened only when an amount of the operation applied to the arm operation member exceeds a preset arm-speed-increase-start operation amount larger than the arm start operation amount to permit the hydraulic oil discharged by the third pump to be merged into the hydraulic oil supplied from the second pump to the arm hydraulic actuator.

2. The hydraulic shovel according to claim 1, wherein the third pump is formed of a variable-displacement hydraulic pump, and the hydraulic shovel further comprises:

a bleed-off passage for letting the hydraulic oil discharged by the third pump to a tank, the bleed-off passage being disposed upstream of the arm merging valve;

a bleed-off valve provided in the bleed-off passage; and a control section configured to minimize a pump displacement volume of the third pump in a region where an amount of the operation applied to the arm operation member is equal to or less than the arm-speed-increase-start operation amount and configured to maximize a meter-in opening of the arm merging valve and minimize an opening of the bleed-off valve while changing the pump displacement volume of the third pump according to an amount of the operation applied to the arm operation member in a region where an amount of the operation applied to the arm operation member exceeds the arm-speed-increase-start operation amount.

3. The hydraulic shovel according to claim 2, wherein:

each of the arm control valve and the arm merging valve is formed of a pilot-controlled selector valve configured to be operated by an input of a pilot pressure;

the control section includes an arm remote control valve that outputs an arm pilot pressure corresponding to an amount of the operation applied to the arm operation member and an arm merging pilot line that leads the arm pilot pressure output by the arm remote control valve to the arm merging valve as the pilot pressure thereof; and the meter-in opening of the arm merging valve has such a characteristic as to be at a minimum when the arm pilot pressure is equal to or less than an arm-speed-increase-start pilot pressure corresponding to the arm-speed-increase-start operation amount and as to be at a maximum when the arm pilot pressure exceeds the arm-speed-increase-start pilot pressure.

4. A hydraulic shovel comprising:

a base;

a boom mounted on the base so as to be raised and lowered;

an arm rotatably coupled to a distal end of the boom;

a bucket rotatably coupled to a distal end of the arm;

a boom hydraulic actuator that is operated so as to raise and lower the boom by receiving supply of hydraulic oil;

an arm hydraulic actuator that is operated so as to rotate the arm relatively to the boom by receiving supply of hydraulic oil;

a bucket hydraulic actuator that is operated so as to rotate the bucket relative to the arm by receiving supply of hydraulic oil;

a first pump that is formed of a hydraulic pump discharging a hydraulic oil, the first pump connected to only the arm hydraulic actuator and the bucket hydraulic actuator in parallel among a group consisting of the boom hydraulic actuator, the arm hydraulic actuator and the bucket hydraulic actuator;

a second pump that is formed of a hydraulic pump discharging a hydraulic oil, the second pump connected to only the arm hydraulic actuator and the boom hydraulic actuator in parallel among the group consisting of the boom hydraulic actuator, the arm hydraulic actuator and the bucket hydraulic actuator;

a third pump that is formed of a hydraulic pump discharging a hydraulic oil, the third pump connected only to the boom hydraulic actuator among the group consisting of the boom hydraulic actuator, the arm hydraulic actuator and the bucket hydraulic actuator;

a boom operation member to which an operation for moving the boom hydraulic actuator is applied;

an arm operation member to which an operation for moving the arm hydraulic actuator is applied;

a bucket operation member to which an operation for moving the bucket hydraulic actuator is applied;

a boom control valve including first pilot port and interposed between the third pump and the boom hydraulic actuator and configured to be opened in response to the operation of the boom operation member when a pilot pressure exceeding a boom start pilot pressure corresponding to a boom start operation amount which has been set in advance with respect to the operation of the boom operation member is input to the first pilot port to control the supply of the hydraulic oil from the third pump to the boom hydraulic actuator;

an arm control valve including a second pilot port and interposed between the second pump and the arm hydraulic actuator and configured to be opened in response to the operation applied to the arm operation member when a pilot pressure exceeding an arm start pilot pressure corresponding to an arm start operation amount which has been set in advance with respect to the operation of the arm operation member is input to the second pilot port to control the supply of the hydraulic oil from the second pump to the arm hydraulic actuator;

a bucket control valve interposed between the first pump and the bucket hydraulic actuator and configured to be opened in response to the operation applied to the bucket operation member to control the supply of the hydraulic oil from the first pump to the bucket hydraulic actuator;

a boom merging valve interposed between the second pump and the boom hydraulic actuator and configured to be opened only when an amount of the operation applied to the boom operation member exceeds a preset boom-speed-increase-start operation amount larger than the boom start operation amount to permit the hydraulic oil discharged by the second pump to be merged into the hydraulic oil supplied from the third pump to the boom hydraulic actuator; and an arm merging valve interposed between the first pump and the arm hydraulic actuator and configured to be opened only when an amount of the operation applied to the arm operation member exceeds a preset arm-speed-increase-start operation amount larger than the arm start operation amount to permit the hydraulic oil discharged by the first pump to be merged into the hydraulic oil supplied from the second pump to the arm hydraulic actuator.

5. The hydraulic shovel according to claim 4, wherein the third pump is formed of a variable-displacement hydraulic pump, and the hydraulic shovel further comprises:

a bleed-off passage for letting the hydraulic oil discharged by the third pump to a tank, the bleed-off passage being disposed upstream of the boom control valve;

a bleed-off valve provided in the bleed-off passage; and a control section configured to minimize a pump displacement volume of the third pump in a region where an amount of the operation applied to the boom operation member is equal to or less than the boom start operation amount for starting the boom hydraulic actuator and configured to maximize a meter-in opening of the boom control valve and minimize an opening of the bleed-off valve in a region where an amount of the operation applied to the boom operation member exceeds the boom start operation amount.

6. The hydraulic shovel according to claim 5, wherein the boom control valve is formed of a pilot-controlled selector valve configured to be operated by an input of a pilot pressure;

the control section includes a boom remote control valve that outputs a boom pilot pressure corresponding to an amount of the operation applied to the boom operation member and a boom control pilot line that leads the boom pilot pressure output by the boom remote control valve to the boom control valve as the pilot pressure thereof; and the meter-in opening of the boom control valve has a characteristic as to be at a minimum when the boom pilot pressure is equal to or less than the boom start pilot pressure corresponding to the boom start operation amount and as to be at a maximum when the boom pilot pressure exceeds the boom start pilot pressure.

* * * * *